US010602298B2

(12) United States Patent
Raghuvanshi et al.

(10) Patent No.: US 10,602,298 B2
(45) Date of Patent: Mar. 24, 2020

(54) DIRECTIONAL PROPAGATION

(71) Applicant: Microsoft Technology Licensing, LLC, Redmond, WA (US)

(72) Inventors: Nikunj Raghuvanshi, Redmond, WA (US); John Snyder, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 16/103,702

(22) Filed: Aug. 14, 2018

(65) Prior Publication Data

US 2019/0356999 A1 Nov. 21, 2019

Related U.S. Application Data

(60) Provisional application No. 62/671,954, filed on May 15, 2018.

(51) Int. Cl.
*H04S 7/00* (2006.01)
*H04S 3/00* (2006.01)

(52) U.S. Cl.
CPC ..... *H04S 7/303* (2013.01); *H04S 3/008* (2013.01); *H04S 7/305* (2013.01);
(Continued)

(58) Field of Classification Search
CPC combination set(s) only.
See application file for complete search history.

(56) References Cited

U.S. PATENT DOCUMENTS 7,146,296 B1 12/2006 Carlbom et al.
7,606,375 B2 10/2009 Bailey et al.
(Continued)

FOREIGN PATENT DOCUMENTS

CN 1735927 A 2/2006
CN 101377925 A 3/2009
(Continued)

OTHER PUBLICATIONS

"Precomputed wave simulation for Real-Time Sound Propagation of Dynamic Sources in Complex Scenes", Journal of ACM Transactions on Graphics, vol. 29, Issue 4, Jul. 2010, pp. 1-11, Nikunj Raghuvanshi (Year: 2010).*
(Continued)

*Primary Examiner* — Duc Nguyen
*Assistant Examiner* — Assad Mohammed
(74) *Attorney, Agent, or Firm* — Rainier Patents, P.S.

(57) ABSTRACT

The description relates to parametric directional propagation for sound modeling and rendering. One implementation includes receiving virtual reality space data corresponding to a virtual reality space. The implementation can include using the virtual reality space data to simulate directional impulse responses for initial sounds emanating from multiple moving sound sources and arriving at multiple moving listeners. The implementation can include using the virtual reality space data to simulate directional impulse responses for sound reflections in the virtual reality space. The directional impulse responses can be encoded and used to render sound that accounts for a geometry of the virtual reality space.

20 Claims, 15 Drawing Sheets

(52) U.S. Cl.
CPC ..... *H04S 2400/01* (2013.01); *H04S 2400/11* (2013.01); *H04S 2420/03* (2013.01)

(56) References Cited

U.S. PATENT DOCUMENTS

| | | | | |
|---|---|---|---|---|
| 7,881,479 | B2 | 2/2011 | Asada | |
| 8,670,850 | B2 | 3/2014 | Soulodre | |
| 10,206,055 | B1 * | 2/2019 | Mindlin | H04S 7/304 |
| 2005/0058297 | A1 | 3/2005 | Jot et al. | |
| 2007/0294061 | A1 | 12/2007 | Carlbom et al. | |
| 2008/0069364 | A1 | 3/2008 | Itou et al. | |
| 2008/0137875 | A1 | 6/2008 | Zong et al. | |
| 2008/0273708 | A1 | 11/2008 | Sandgren et al. | |
| 2009/0046864 | A1 | 2/2009 | Mahabub et al. | |
| 2009/0326960 | A1 | 12/2009 | Breebaat | |
| 2011/0081023 | A1 * | 4/2011 | Raghuvanshi | H04S 7/30 381/17 |
| 2012/0269355 | A1 | 10/2012 | Chandak et al. | |
| 2013/0120569 | A1 * | 5/2013 | Mizuta | A63F 13/54 348/143 |
| 2014/0016784 | A1 * | 1/2014 | Sen | G10L 19/008 381/17 |
| 2014/0219458 | A1 * | 8/2014 | Tanaka | H04S 3/002 381/17 |
| 2015/0373475 | A1 * | 12/2015 | Raghuvanshi | H04S 7/30 381/303 |
| 2016/0212563 | A1 * | 7/2016 | Yuyama | H04S 7/303 |
| 2018/0035233 | A1 | 2/2018 | Fielder et al. | |

FOREIGN PATENT DOCUMENTS

| | | | |
|---|---|---|---|
| CN | 101406074 | A | 4/2009 |
| CN | 101770778 | A | 7/2010 |
| CN | 103098476 | A | 5/2013 |
| EP | 1437712 | A2 | 7/2004 |

OTHER PUBLICATIONS

"Acoustics-Measurement of Room Acoustic Parameters—Part 1: Performance Spaces", In Proceedings of International Organization for Standardization, International Standards for Business, Government and Society, ISO 3382-1, Jan. 2009, 2 Pages.
"Interactive 3D Audio Rendering Guidelines, Level 2.0", In Proceedings of the 3D Working Group of the Interactive Audio Special Interest Group, Sep. 20, 1999, 29 Pages.
"Final Office Action Issued in U.S. Appl. No. 12/573,157", dated Feb. 17, 2015, 18 Pages.
"Final Office Action Issued in U.S. Appl. No. 12/573,157", dated Jul. 5, 2013, 18 Pages.
"Non Final Office Action Issued in U.S. Appl. No. 12/573,157", dated Apr. 23, 2014, 19 Pages.
"Non Final Office Action Issued in U.S. Appl. No. 12/573,157", dated Aug. 20, 2015, 18 Pages.
"Non Final Office Action Issued in U.S. Appl. No. 12/573,157", dated Nov. 28, 2012, 12 Pages.
"Non-Final Office Action Issued in U.S. Appl. No. 14/311,208", dated Jan. 7, 2016, 7 Pages.
"Office Action Issued in European Patent Application No. 15738178.1", dated Apr. 25, 2017, 5 Pages.
"First Office Action and Search Report Issued in Chinese Patent Application No. 201580033425.5", dated Dec. 7, 2017, 9 Pages.
Ajdler, et al., "The Plenacoustic Function and Its Sampling", In IEEE Transactions on Signal Processing, vol. 54, Issue 10, Oct. 2006, pp. 3790-3804.
Astheimer, Peter, "What You See Is What You Hear—Acoustics Applied in Virtual Worlds", In IEEE Symposium on Research Frontiers in Virtual Reality, Oct. 25, 1993, pp. 100-107.
Bradley, et al., "Accuracy and Reproducibility of Auditorium Acoustics Measures", In Proceedings of the British Institute of Acoustics, vol. 10, Part 2, May 6, 2014, pp. 339-406.
Calamia, Paul Thomas, "Advances in Edge-Diffraction Modeling for Virtual-Acoustic Simulations", In Doctoral Dissertation of Princeton University, in Candidacy for the Degree of Doctor of Philosophy, Jun. 2009, 159 Pages.
Chandak, et al., "AD Frustum: Adaptive Frustum Tracing for Interactive Sound Propagation", In IEEE Transactions on Visualization and Computer Graphics, vol. 14, Issue 6, Nov. 2008, pp. 1707-1714.
Cheng, et al., "Heritage and Early History of the Boundary Element Method", In Proceedings of the Engineering Analysis with Boundary Elements, vol. 29, Issue 3, Mar. 2005, pp. 268-302.
Funkhouser, et al., "A Beam Tracing Method for Interactive Architectural Acoustics", In Journal of the Acoustical Society of America, vol. 115, Feb. 2004, pp. 739-756.
Funkhouser, et al., "Realtime Acoustic Modeling for Distributed Virtual Environments", In Proceedings of the 26th Annual Conference on Computer Graphics and Interactive Techniques, Jul. 1, 1999, pp. 365-374.
Funkhouser, et al., "Survey of Methods for Modeling Sound Propagation in Interactive Virtual Environment Systems", In Journal—Presence and Teleoperation, Jan. 2003, 53 Pages.
Gade, Anders, "Acoustics in Halls for Speech and Music", In the Springer Handbook of Acoustics, Jan. 2007, 8 Pages.
Gumerov, et al., "Fast Multipole Methods on Graphics Processors", In Journal of Computational Physics, vol. 227, Issue 18, Sep. 10, 2008, 4 Pages.
Harris, Frederic J., "On the Use of Windows for Harmonic Analysis with the Discrete Fourier Transform", In Proceedings of the IEEE, vol. 66, Issue 1, Jan. 1978, pp. 51-84.
Hodgson, et al., "Experimental Evaluation of Radiosity for Room Sound-Field Prediction", In the Journal of the Acoustical Society of America, vol. 120, No. 2, Aug. 2006, pp. 808-819.
Kolarik, et al., "Perceiving Auditory Distance Using Level and Direct-to-Reverberant Ratio Cues", In the Journal of the Acoustical Society of America, vol. 130, Issue 4, Oct. 2011, 4 Pages.
Krokstad, Asbjorn, "The Hundred Years Cycle in Room Acoustic Research and Design", In Proceedings of the Reflections on Sound, Norwegian University of Science and Technology, Jun. 2008, 30 Pages.
Kuttruff, Heinrich, "Room Acoustics, Fourth Edition", In Book—Room Acoustics, Fourth Edition, Published by CRC Press, Aug. 3, 2000, 1 Page.
Lauterbach, et al., "Interactive Sound Rendering in Complex and Dynamic Scenes Using Frustum Tracing", In IEEE Transactions on Visualization and Computer Graphics, vol. 13, Issue 6, Nov. 2007, pp. 1672-1679.
Lentz, et al., "Virtual Reality System with Integrated Sound Field Simulation and Reproduction", in EURASIP Journal on Applied Signal Processing, vol. 2007, Issue 01, Jan. 1, 2007, 22 Pages.
Li, et al., "Spatial Sound Rendering Using Measured Room Impulse Responses", In IEEE International Symposium on Signal Processing and Information Technology, Aug. 27, 2006, pp. 432-434.
Lokki, et al., "Creating Interactive Virtual Auditory Environments", In IEEE on Computer Graphics and Applications, vol. 22, Issue 4, Jul. 1, 2002, pp. 49-57.
Mehra, et al., "An Efficient GPU-Based Time Domain Solver for the Acoustic Wave Equation", In Proceedings of the Applied Acoustics, vol. 73, Issue 02, Feb. 29, 2012, pp. 83-94.
Mehra, et al., "Wave-Based Sound Propagation in Large Open Scenes Using an Equivalent Source Formulation", In Journal of ACM transactions on Graphics, vol. 32, Issue 02, Apr. 1, 2013, 13 Pages.
Mehrotra, et al., "Interpolation of Combined Head and Room Impulse Response for Audio Spatialization", In IEEE 13th International Workshop on Multimedia Signal Processing, Oct. 17, 2011, pp. 1-6.
"International Search Report and Written Opinion issued in PCT Application No. PCT/US2015/036767", dated Sep. 14, 2015, 18 Pages.
Peter, et al., "Frequency-Domain Edge Diffraction for Finite arid Infinite Edges", In Proceedings of the Acta Acustica United with Acustica, vol. 95, Issue 3, May 2009, pp. 568-572.

(56) References Cited

OTHER PUBLICATIONS

Pierce, et al., "Acoustics: An Introduction to Its Physical Principles and Applications", In Book of Acoustics: An Introduction to Its Physical Principles and Applications, Published by Acoustical Society of America, Illustrated Edition, Jun. 1989, 4 Pages.
Raghuvanshi, et al., "Efficient and Accurate Sound Propagation Using Adaptive Rectangular Decomposition", In IEEE Transactions on Visualization and Computer Graphics, vol. 15, Issue 5, Sep. 1, 2009, pp. 789-801.
Raghuvanshi, Nikunj, "Interactive Physically-Based Sound Simulation", In a Dissertation Submitted to the Faculty of The University of North Carolina at Chapel Hill in Partial Fulfillment of the Requirements for the Degree of Doctor of Philosophy in the Department of Computer Science, Aug. 1, 2010, 187 Pages.
Raghuvanshi, et al., "Parametric Wave Field Coding for Precomputed Sound Propagation", In Proceedings of the ACM Transactions on Graphics, vol. 33, Issue 4, Jul. 27, 2014, 11 Pages.
Raghuvanshi, et al., "Precomputed Wave Simulation for Real-Time Sound Propagation of Dynamic Sources in Complex Scenes", In Proceedings of the ACM Transactions on Graphics, vol. 29, Issue 4, Jul. 26, 2010, 11 Pages.
Rindel, et al., "The Use of Colors, Animations and Auralizations in Room Acoustics", In Proceedings of the Inter Noise Conference, Sep. 15, 2013, pp. 4396-4404.
Sabine, Hale J., "Room Acoustics", In Proceedings of the Transactions of the IRE Professional Group on Audio, vol. 1, Issue 4, Jul. 1953, pp. 4-12.
Sakamoto, et al., "Calculation of Impulse Responses and Acoustic Parameters in a Hall by the Finite-Difference Time-Domain Method", In Proceedings of the Acoustical Science and Technology, vol. 29, Issue 4, Feb. 2008, pp. 256-265.
Savioja, Lauri, "Real-Time 3D Finite-Difference Time-Domain Simulation of Mid-Frequency Room Acoustics", In Proceedings of the 13th International Conference on Digital Audio Effects, Sep. 6, 2010, 8 Pages.
Savioja, et al., "Simulation of Room Acoustics with a 3-D Finite Difference Mesh", In Proceedings of the International Computer Music Conference, Sep. 1994, pp. 463-466.
Stettner, et al., "Computer Graphics Visualization for Acoustic Simulation", In Proceedings of the 16th Annual Conference on Computer Graphics and Interactive Techniques, vol. 23, Issue 3, Jul. 1, 1989, pp. 195-205.
Svensson, et al., "The Use of Ambisonics in Describing Room Impulse Responses", In Proceedings of the International Congress on Acoustics, Apr. 2004, pp. 2481-2483.
Takala, et al., "Sound Rendering", In Proceedings of the 19th Annual Conference on Computer Graphics and Interactive Techniques, vol. 26, Issue 2, Jul. 1, 1992, pp. 211-220.
Taylor, et al., "RESound: Interactive Sound Rendering for Dynamic Virtual Environments", In Proceedings of the 17th ACM International Conference on Multimedia, Oct. 19, 2009, pp. 271-280.
Thompson, Lonny L., "A Review of Finite-Element Methods for Time-Harmonic Acoustics", In Journal of Acoustical Society of America, vol. 119, Issue 3, Mar. 2006, pp. 1315-1330.
Valimaki, et al., "Fifty Years of Artificial Reverberation", In IEEE Transactions on Audio, Speech, and Language Processing, vol. 20, Issue 5, Jul. 2012, pp. 1421-1448.
Vorm, Jochem Van Der., "Transform Coding of Audio Impulse Responses", In Proceedings of the Master's Thesis, Laboratory of Acoustical Imaging and Sound Control, Department of Imaging Science and Technology, Faculty of Applied Sciences, Delft University of Technology, Aug. 2003, 109 Pages.
Wand, et al., "A Real-Time Sound Rendering Algorithm for Complex Scenes", In Proceedings of the Technical Report, University of Tubingen, WSI-2003-5, ISSN 0946-3852, Jul. 2003, 13 Pages.
Yeh, et al., "Wave-Ray Coupling for Interactive Sound Propagation in Large Complex Scenes", In Proceedings of the ACM Transactions on Graphics (TOG), vol. 32, Issue 6, Nov. 1, 2013, 11 Pages.
Menzer, Fritz, "Efficient Binaural Audio Rendering Using Independent Early and Diffuse Paths", In Proceedings of 132nd Audio Engineering Society Convention, Apr. 26, 2012, 9 Pages.
"International Search Report and Written Opinion Issued in PCT Application No. PCT/US19/029559", dated Jul. 12, 2019, 14 Pages.
Allen, et al., "Aerophones in Flatland: Interactive Wave Simulation of Wind Instruments", In Journal of ACM Transactions on Graphics (TOG), vol. 34, Issue 4, Aug. 1, 2015, 11 Pages.
Bilbao, et al., "Directional Sources in Wave-Based Acoustic Simulation", In Proceedings of the IEEE/ACM Transactions on Audio, Speech, and Language Processing, vol. 27 , Issue 2, Feb. 1, 2019, pp. 415-428.
Cao, et al., "Interactive Sound Propagation with Bidirectional Path Tracing", In Journal ACM Transactions on Graphics (TOG), vol. 35, Issue 6, Nov. 1, 2016, 11 Pages.
Chadwick, et al., "Harmonic Shells: a Practical Nonlinear Sound Model for Near-rigid Thin Shells", In Proceedings of the ACM SIGGRAPH Asia papers Article No. 119, Dec. 16, 2009, 10 Pages.
Chaitanya, et al., "Adaptive Sampling for Sound Propagation", In Proceedings of the IEEE Transactions on Visualization and Computer Graphics, vol. 25 , Issue 5, May 1, 2019, pp. 1846-1854.
Gumerov, et al., "Fast Multipole Methods for the Helmholtz Equation in Three Dimensions", A Volume in Elsevier Series in Electromagnetism, Jan. 1, 2004, 11 Pages.
James, et al., "Precomputed Acoustic Transfer: Output-sensitive, Accurate Sound Generation for Geometrically Complex Vibration Sources", In Journal of ACM Transactions on Graphics (TOG), vol. 25, Issue 3, Jul. 1, 2006, pp. 987-995.
Litovsky, et al., "The Precedence Effect", In the Journal of the Acoustical Society of America vol. 106, Issue 4, Oct. 1999, pp. 1633-1654.
Mehra, et al., "Source and Listener Directivity for Interactive Wave-Based Sound Propagation.", In Proceedings of the IEEE Transactions on Visualization and Computer Graphics, vol. 20 , Issue 4, Apr. 1, 2014, pp. 495-503.
Pulkki, Ville, "Spatial Sound Reproduction with Directional Audio Coding", In Proceedings of the JAES vol. 55 Issue 6, Jun. 15, 2007, pp. 503-516.
Raghuvanshi, et al., "Parametric Directional Coding for Precomputed Sound Propagation", In Journal of ACM Transactions on Graphics (TOG) TOG Homepage archive, vol. 37, Issue 4, Aug. 2018, 14 Pages.
Zhang, et al., "Ambient Sound Propagation", In Journal of ACM Transactions on Graphics (TOG), vol. 37, Issue 6, Nov. 1, 2018, 10 Pages.
Savioja, et al., "Overview of Geometrical Room Acoustic Modeling Techniques", In the Journal of Acoustical Society of America, vol. 138, Issue 2, Aug. 1, 2015, pp. 708-730.
Wang, et al., "Toward Wave-based Sound Synthesis for Computer Animation", In Journal of ACM Transactions on Graphics (TOG) vol. 37, Issue 4, Jul. 1, 2018, 16 Pages.

* cited by examiner

SCENARIO 102A

SCENARIO 102B

SCENARIO 102A

SCENARIO 402

SCENARIO 702

SCENARIO 702

SCENARIO 702

METHOD 1500

DIRECTIONAL PROPAGATION

BACKGROUND

Practical modeling and rendering of real-time directional acoustic effects (e.g., sound, audio) for video games and/or virtual reality applications can be prohibitively complex. Conventional methods constrained by reasonable computational budgets have been unable to render authentic, convincing sound with true-to-life directionality of initial sounds and/or multiply-scattered sound reflections, particularly in cases with occluders (e.g., sound obstructions). Room acoustic modeling (e.g., concert hall acoustics) does not account for free movement of either sound sources or listeners. Further, sound-to-listener line of sight is usually unobstructed in such applications. Conventional real-time path tracing methods demand enormous sampling to produce smooth results, greatly exceeding reasonable computational budgets. Other methods are limited to oversimplified scenes with few occlusions, such as an outdoor space that contains only 10-20 explicitly separated objects (e.g., building facades, boulders). Some methods have attempted to account for sound directionality with moving sound sources and/or listeners, but are unable to also account for scene acoustics while working within a reasonable computational budget. Still other methods neglect sound directionality entirely. In contrast, the parametric directional propagation concepts described herein can generate convincing audio for complex video gaming and/or virtual reality scenarios while meeting a reasonable computational budget.

BRIEF DESCRIPTION OF THE DRAWINGS

The accompanying drawings illustrate implementations of the concepts conveyed in the present document. Features of the illustrated implementations can be more readily understood by reference to the following description taken in conjunction with the accompanying drawings. Like reference numbers in the various drawings are used wherever feasible to indicate like elements. In some cases, parentheticals are utilized after a reference number to distinguish like elements. Use of the reference number without the associated parenthetical is generic to the element. Further, the left-most numeral of each reference number conveys the FIG. and associated discussion where the reference number is first introduced.

DETAILED DESCRIPTION

Overview

This description relates to generating convincing sound for video games, animations, and/or virtual reality scenarios. Hearing can be thought of as directional, complementing vision by detecting where (potentially unseen) sound events occur in an environment of a person. For example, standing outside a meeting hall, the person is able to locate an open door by listening for the chatter of a crowd in the meeting hall streaming through the door. By listening, the person may be able to locate the crowd (via the door) even when sight of the crowd is obscured to the person. As the person walks through the door, entering the meeting hall, the auditory scene smoothly wraps around them. Inside the door, the person is now able to resolve sound from individual members of the crowd, as their individual voices arrive at the person's location. The directionality of the arrival of an individual voice can help the person face and/or navigate to a chosen individual.

Aside from the initial sound arrival, reflections and/or reverberations of sound are another important part of an auditory scene. For example, while reflections can envelop a listener indoors, partly open spaces may yield anisotropic reflections, which can sound different based on a direction a listener is facing. In either situation, the sound of reflections can reinforce the visual location of nearby scene geometry. For example, when a sound source and listener are close (e.g., within footsteps), a delay between arrival of the initial sound and corresponding first reflections can become audible. The delay between the initial sound and the reflections can strengthen the perception of distance to walls. The generation of convincing sound can include accurate and efficient simulation of sound diffracting around obstacles, through portals, and scattering many times. Stated another way, directionality of an initial arrival of a sound can determine a perceived direction of the sound, while the directional distribution of later arriving reflections of the sound can convey additional information about the surroundings of a listener.

Parametric directional propagation concepts can provide practical modeling and/or rendering of such complex directional acoustic effects, including movement of sound sources and/or listeners within complex scene geometries. Proper rendering of directionality of an initial sound and reflections can greatly improve the authenticity of the sound in general, and can even help the listener orient and/or navigate in a scene. Parametric directional propagation concepts can generate convincing sound for complex scenes in real-time, such as while a user is playing a video game, or while a colleague is participating in a teleconference. Additionally, parametric directional propagation concepts can generate convincing sound while staying within a practical computational budget.

Example Introductory Concepts

Figure 1A:
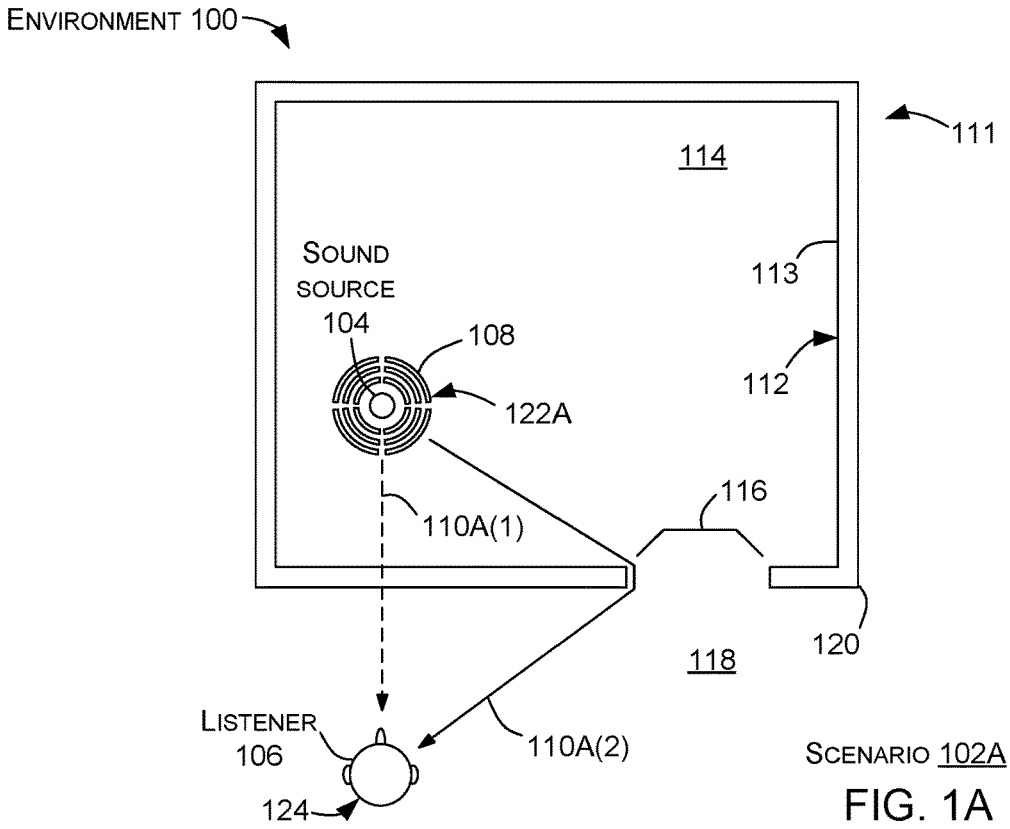
FIGS. 1A-4 and 7A illustrate example parametric directional propagation environments that are consistent with some implementations of the present concepts.
Figure 1B:
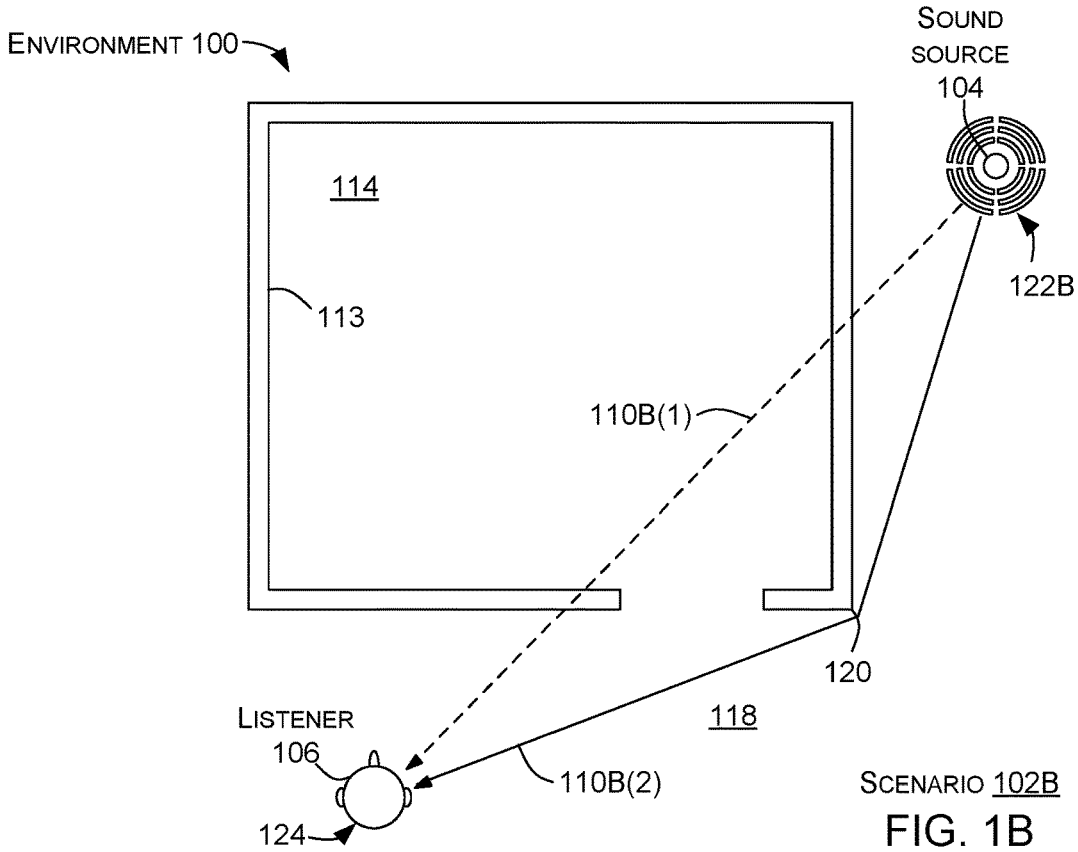
Figure 2:
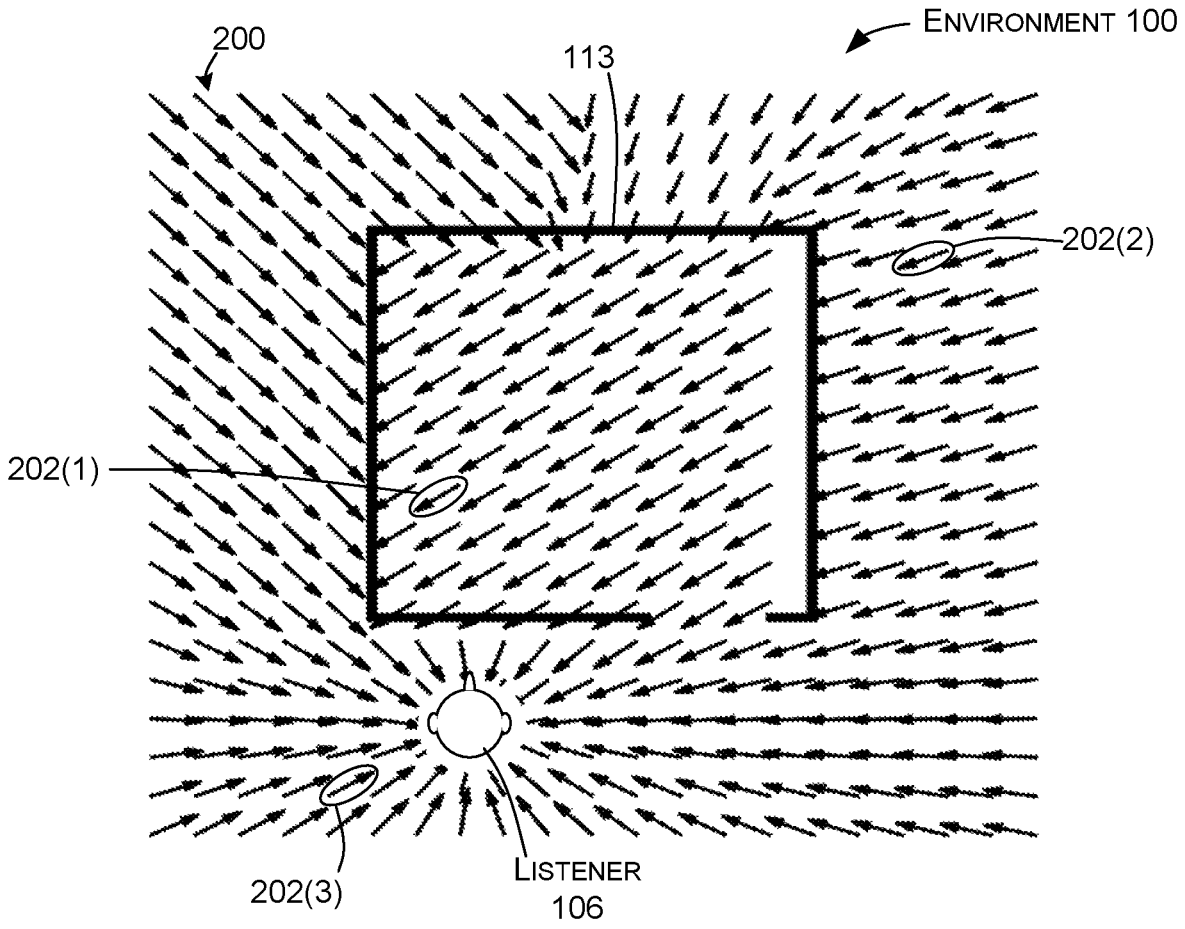
Figure 3:
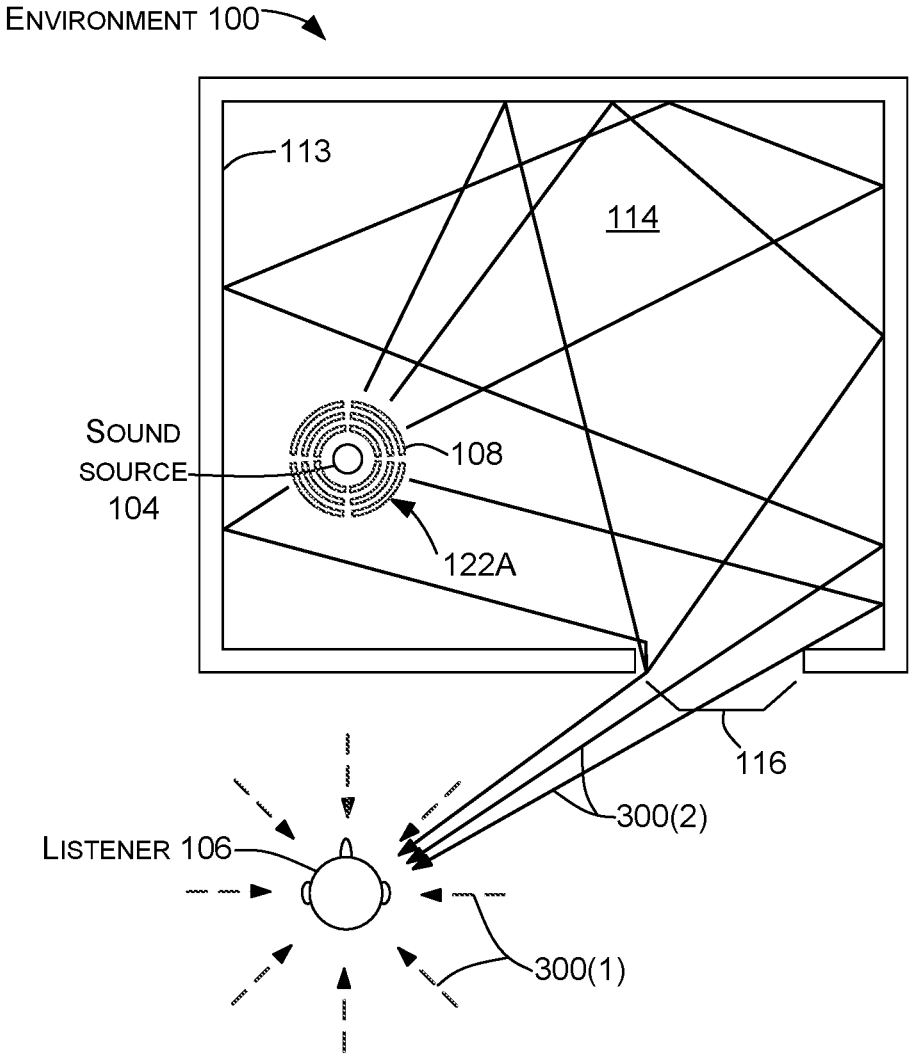
Figure 4:
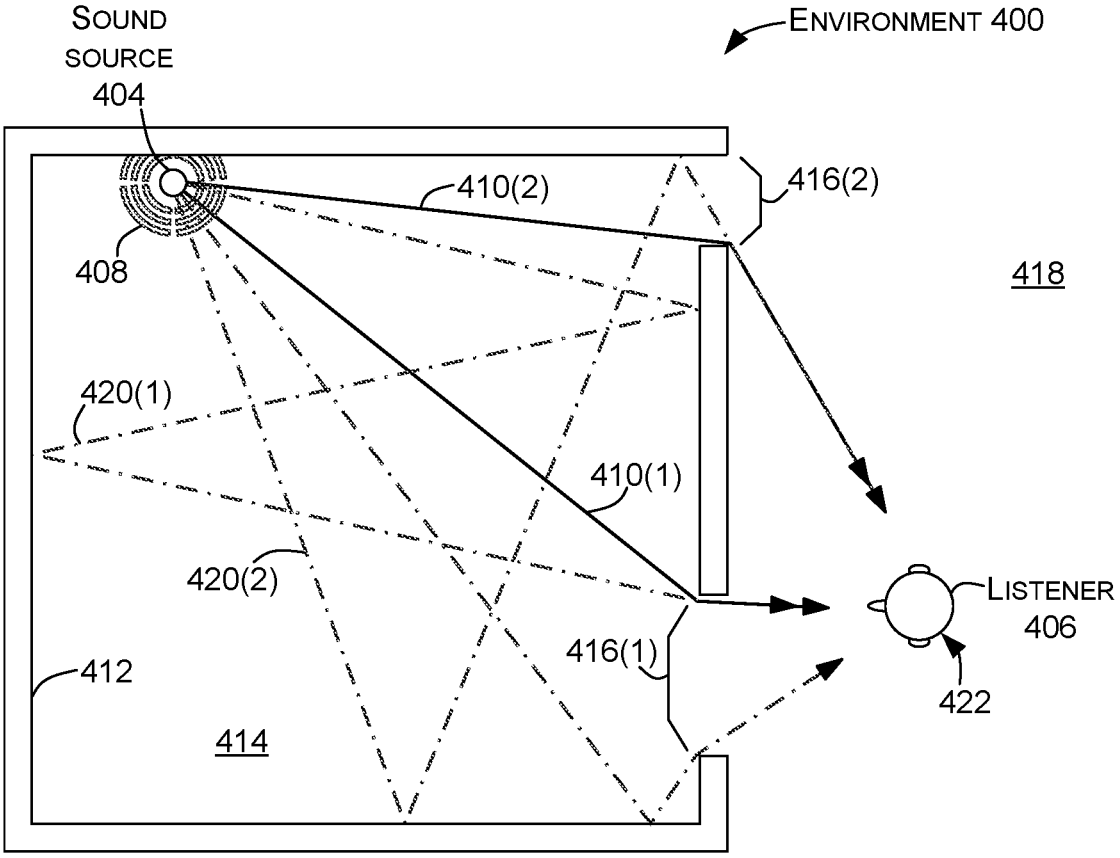
Figure 5:
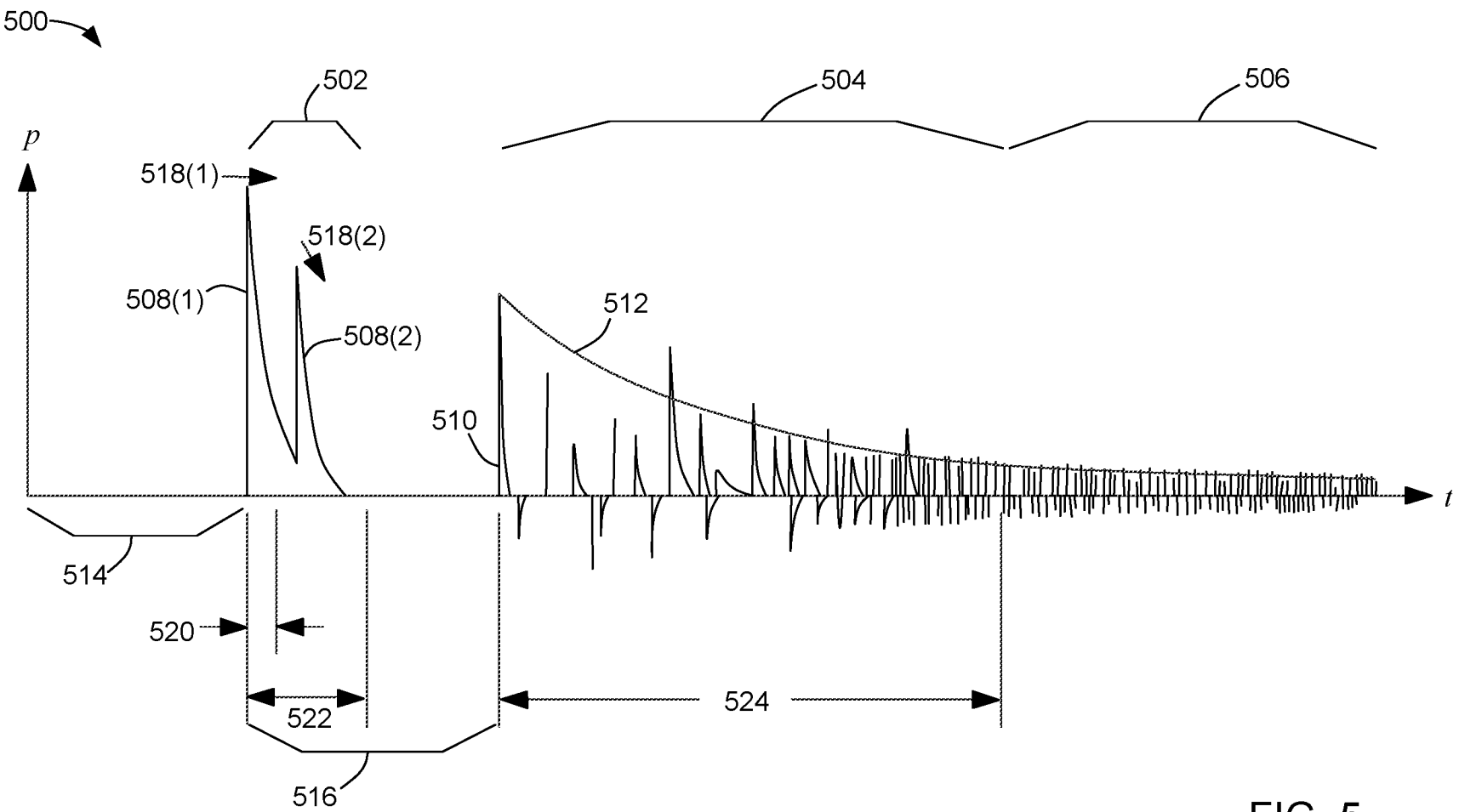
FIGS. 5 and 7B-11 show example parametric directional propagation graphs and/or diagrams that are consistent with some implementations of the present concepts.

FIGS. 1A-5 are provided to introduce the reader to parametric directional propagation concepts. FIGS. 1A-3 collectively illustrate parametric directional propagation concepts relative to a first example parametric directional propagation environment 100. FIGS. 1A, 1B, and 3 provide views of example scenarios 102 that can occur in environment 100. FIGS. 4 and 5 illustrate further parametric directional propagation concepts.

As shown in FIGS. 1A and 1B, example environment 100 can include a sound source 104 and a listener 106. The sound source 104 can emit a pulse 108 (e.g., sound, sound event). The pulse 108 can travel along an initial sound wavefront 110 (e.g., path). Environment 100 can also have a geometry 111, which can include structures 112. In this case, the structures 112 can be walls 113, which can generally form a room 114 with a portal 116 (e.g., doorway), an area outside 118 the room 114, and at least one exterior corner 120. A location of the sound source 104 in environment 100 can be generally indicated at 122, while a location of the listener 106 is indicated at 124.

As used herein, the term geometry 111 can refer to an arrangement of structures 112 (e.g., physical objects) and/or open spaces in an environment. In some implementations, the structures 112 can cause occlusion, reflection, diffraction, and/or scattering of sound, etc. For instance, in the example of FIG. 1A, the structures 112, such as walls 113 can act as occluders that occlude (e.g., obstruct) sound. Additionally, the structures, such as walls 113 (e.g., wall surfaces) can act as reflectors that reflect sound. Some additional examples of structures that can affect sound are furniture, floors, ceilings, vegetation, rocks, hills, ground, tunnels, fences, crowds, buildings, animals, stairs, etc. Additionally, shapes (e.g., edges, uneven surfaces), materials, and/or textures of structures can affect sound. Note that structures do not have to be solid objects. For instance, structures can include water, other liquids, and/or types of air quality that might affect sound and/or sound travel.

In the example illustrated in FIG. 1A, two potential initial sound wavefronts 110A of pulse 108 are shown leaving the sound source 104 and propagating to the listener 106 at listener location 124. For instance, initial sound wavefront 110A(1) travels straight through the wall 113 toward the listener 106, while initial sound wavefront 110A(2) passes through the portal 116 before reaching the listener 106. As such, initial sound wavefronts 110A(1) and 110A(2) arrive at the listener from different directions. Initial sound wavefronts 110A(1) and 110A(2) can also be viewed as two different ways to model an initial sound arriving at listener 106. However, in environment 100, where the walls 113 act as an occluder, an initial sound arrival modeled according to the example of initial sound wavefront 110A(1) might produce less convincing sound because the sound dampening effects of the wall may diminish the sound at the listener to below that of initial sound wavefront 110A(2). Thus, a more realistic initial sound arrival might be modeled according to the example of initial sound wavefront 110A(2), arriving toward the right side of listener 106. For instance, in a virtual reality world based on scenario 102A, a person (e.g., listener) looking at a wall with a doorway to their right would likely expect to hear a sound coming from their right side, rather than through the wall. Note that this phenomena is affected by wall composition (e.g., a wall made out of a sheet of paper would not have the same sound dampening effect as a wall made out of 12 inches of concrete, for example). Parametric directional propagation concepts can be used to ensure a listener hears any given initial sound with realistic directionality, such as coming from the doorway in this instance.

In some cases, the sound source 104 can be mobile. For example, scenario 102A depicts the sound source 104 at location 122A, and scenario 102B depicts the sound source 104 at location 122B. In scenario 102B both the sound source 104 and listener are outside 118, but the sound source 104 is around the exterior corner 120 from the listener 106. Once again, the walls 113 obstruct a line of sight (and/or wavefront travel) between the listener 106 and the sound source 104. Here again a first potential initial sound wavefront 110B(1) can be a less realistic model for an initial sound arrival at listener 106, since it would pass through walls 113. Meanwhile, a second potential initial sound wavefront 110B(2) can be a more realistic model for an initial sound arrival at listener 106.

Environment 100 is shown again in FIG. 2, including the listener 106 and the walls 113. FIG. 2 depicts an example encoded directional impulse response field 200 for environment 100. The encoded directional impulse response field 200 can be composed of multiple individual encoded directional impulse responses 202, depicted as arrows in FIG. 2. Only three individual encoded directional impulse responses 202 are designated with specificity in FIG. 2 to avoid clutter on the drawing page. In this example, the encoded directional impulse response 202(1) can be related to initial sound wavefront 110A(2) from scenario 102A (FIG. 1A). Similarly, the encoded directional impulse response 202(2) can be related to initial sound wavefront 110B(2) from scenario 102B (FIG. 1B). For instance, notice that the arrow depicting encoded directional impulse response 202(1) is angled similarly to the arrival direction of initial sound wavefront 110A(2) at the listener 106 in FIG. 1A. Similarly, the arrow depicting encoded directional impulse response 202(2) is angled similarly to the arrival direction of initial sound wavefront 110B(2) at the listener 106 in FIG. 1B. In contrast, encoded directional impulse response 202(3) is located to the left of and slightly lower than listener 106 on the drawing page in FIG. 2. Accordingly, the arrow depicting encoded directional impulse response 202(3) is pointing in roughly an opposite direction from either of encoded directional impulse responses 202(1) or 202(2), indicating that a sound emanating from a respective location to encoded directional impulse response 202(3) would arrive at listener 106 from roughly the opposite direction as in either of scenarios 102A or 102B (FIGS. 1A and 1B).

The encoded directional impulse response field 200, as shown in FIG. 2, can be a visual representation of realistic arrival directions of initial sounds at listener 106 for a sound source 104 at virtually any location in environment 100. Note that in other scenarios, listener 106 could be moving as well. As such, additional encoded directional impulse response fields could be produced for any location of the listener 106 in environment 100. Parametric directional propagation concepts can include producing encoded directional impulse response fields for virtual reality worlds and/or using the encoded directional impulse response fields to render realistic sound for the virtual reality worlds. The production and/or use of encoded directional impulse response fields will be discussed further relative to FIG. 6, below.

FIGS. 1A-2 have been used to discuss parametric directional propagation concepts related to an initial sound emanating from a sound source 104 and arriving at a listener 106. FIG. 3 will now be used to introduce concepts relating to reflections and/or reverberations of sound relative to environment 100. FIG. 3 again shows scenario 102A, with the sound source 104 at location 122A (as in FIG. 1A). For sake of brevity, not all elements from FIG. 1A will be reintroduced in FIG. 3. In this case, FIG. 3 also includes reflection wavefronts 300. In FIG. 3, only a few reflection wavefronts 300 are designated to avoid clutter on the drawing page.

Here again, less realistic and more realistic models of reflections can be considered. For instance, as shown in the example in FIG. 3, reflections originating from pulse 108 can be modeled as simply arriving at listener 106 from all directions, indicated with potential reflection wavefronts 300(1). For instance, reflection wavefronts 300(1) can represent simple copies of sound associated with pulse 108 surrounding listener 106. However, reflection wavefronts 300(1) might create an incorrect sense of sound envelopment of the listener 106, as if the sound source and listener were in a shared room.

In some implementations, reflection wavefronts 300(2) can represent a more realistic model of sound reflections. Reflection wavefronts 300(2) are shown in FIG. 3 emanating from sound source 104 and reflecting off walls 113 inside the room 114. In FIG. 3, some of the reflection wavefronts 300(2) pass out of room 114, through the portal 116, and toward listener 106. Reflection wavefronts 300(2) account for the complexity of the room geometry. As such, the directionality of the sound at listener 106 has been preserved with reflection wavefronts 300(2), in contrast to reflection wavefronts 300(1), which simply surround listener 106. Stated another way, a model of sound reflections that accounts for reflections off of and/or around structures of scene geometry can be more realistic than simply surrounding a listener with non-directional incoming sound.

In FIG. 3, only a few reflection wavefronts 300(2) are depicted to avoid clutter on the drawing page. Note that true sound propagation may be thought of as similar to ripples in a pond emanating from a point source, rather than individual rays of light, for instance. In FIG. 2, encoded directional impulse response field 200 was provided as a representation of realistic arrival directions of initial sounds at listener 106. A reflection response field can be generated to model the directionality of arrivals of sound reflections. However, it is difficult to provide a similar visual representation for a reflection response field due the inherent complexity of the rippling sound. In some cases, perceptual parameter field can be used to refer to encoded directional impulse response fields related to initial sounds and/or to reflection response fields related to sound reflections. Perceptual parameter fields will be discussed further relative to FIG. 6, below.

Taken together, realistic directionality of both initial sound arrivals and sound reflections can improve sensory immersion in virtual environments. For instance, proper sound directionality can complement visual perception, such that hearing and vision are coordinated, as one would expect in reality. Further introductory parametric directional propagation concepts will now be provided relative to FIGS. 4 and 5. The examples shown in FIGS. 4 and 5 include aspects of both initial sound arrival(s) and sound reflections for a given sound event.

FIG. 4 illustrates an example environment 400 and scenario 402. Similar to FIG. 1A, FIG. 4 includes a sound source 404 and a listener 406. The sound source 404 can emit a pulse 408. The pulse 408 can travel along initial sound wavefronts 410 (solid lines in FIG. 4). Environment 400 can also include walls 412, a room 414, two portals 416, and an area outside 418. Sound reflections bouncing off walls 412 are shown in FIG. 4 as reflection wavefronts 420 (dashed lines in FIG. 4). A listener location is generally indicated at 422.

In this example, the two portals 416 add complexity to the scenario. For instance, each portal presents an opportunity for a respective initial sound arrival to arrive at listener location 422. As such, this example includes two initial sound wavefronts 410(1) and 410(2). Similarly, sound reflections can pass through both portals 416, indicated by the multiple reflection wavefronts 420. Detail regarding the timing of these arrivals will now be discussed relative to FIG. 5.

FIG. 5 includes an impulse response graph 500. The x-axis of graph 500 can represent time and the y-axis can represent pressure deviation (e.g., loudness). Portions of graph 500 can generally correspond to initial sound(s), reflections, and reverberations, generally indicated at 502, 504, and 506, respectively. Graph 500 can include initial sound impulse responses (IR) 508, reflection impulse responses 510, decay time 512, an initial sound delay 514, and a reflection delay 516.

In this case, initial sound impulse response 508(1) can correspond to initial sound wavefront 410(1) of scenario 402 (FIG. 4), while initial sound impulse response 508(2) can correspond to initial sound wavefront 410(1). Note that in the example shown in FIG. 4, a path length of initial sound wavefront 410(1) from the sound source 404 to the listener 406 is slightly shorter than a path length of initial sound wavefront 410(2). Accordingly, initial sound wavefront 410(1) would be expected to arrive earlier at listener 406 and sound slightly louder than initial sound wavefront 410(2). (Initial sound wavefront 410(2) could sound relatively quieter since the longer path length might allow more dissipation of sound, for instance.) Therefore, in graph 500, initial sound impulse response 508(1) is further left along the x-axis and also has a higher peak on the y-axis than initial sound impulse response 508(2).

Graph 500 also depicts the multiple reflection impulse responses 510 in section 504 of graph 500. Only the first reflection impulse response 510 is designated to avoid clutter on the drawing page. The reflection impulse responses 510 can attenuate over time, with peaks generally lowering on the y-axis of graph 500, which can represent diminishing loudness. The attenuation of the reflection impulse responses 510 over time can be represented and/or modeled as decay time 512. Eventually the reflections can be considered reverberations, indicated in section 506.

Graph 500 also depicts the initial sound delay 514. Initial sound delay 514 can represent an amount of time between the initiation of the sound event, in this case at the origin of graph 500, and the initial sound impulse response 508(1). The initial sound delay 514 can be related to the path length of initial sound wavefront 410(1) from the sound source 404 to the listener 406 (FIG. 4). Therefore, proper modeling of initial sound wavefront 410(1), propagating around walls 412 and through portal 416(1), can greatly improve the realness of rendered sound by more accurately timing the initial sound delay 514. Following the initial sound delay 514, graph 500 also depicts the reflection delay 516. Reflection delay 516 can represent an amount of time between the initial sound impulse response 508(1) and arrival of the first reflection impulse response 510. Here again, proper timing of the reflection delay 516 can greatly improve the realness of rendered sound.

Additional aspects related to timing of the initial sound impulse responses 508 and/or the reflection impulse responses 510 can also help model realistic sound. For example, timing can be considered when modeling directionality of the sound and/or loudness of the sound. In FIG. 5, arrival directions 518 of the initial sound impulse responses 508 are indicated as arrows corresponding to the 2D directionality of the initial sound wavefronts 410 in FIG. 4. (Directional impulse responses will be described in more detail relative to FIGS. 7A-7C, below.) In some cases, the directionality of initial sound impulse response 508(1), corresponding to the first sound to arrive at listener 406, can be more helpful in modeling realistic sound than the directionality of the second-arriving initial sound impulse response 508(2). Stated another way, in some implementations, the directionality of any initial sound impulse response 508 arriving within the first 1 ms (for example) after the initial sound delay 514 can be used to model realistic sound. In FIG. 5, a time window for capturing the directionality of initial sound impulse responses 508 is shown at initial direction time gap 520. In some cases, the directionality of the initial sound impulse responses 508 from the initial direction time gap 520 can be used to produce an encoded directional impulse response, such as in the examples described above relative to FIG. 2.

Similarly, initial sound loudness time gap 522 can be used to model how loud the initial sound impulse responses 508 will seem to a listener. In this case, the initial sound loudness time gap 522 can be 10 ms. For instance, the height of peaks of initial sound impulse responses 508 on graph 500 occurring within 10 ms after the initial sound delay 514 can be used to model the loudness of initial sound arriving at a listener. Furthermore, a reflection loudness time gap 524 can be a length of time, after the reflection delay 516, used to model how loud the reflection impulse responses 510 will seem to a listener. In this case, the reflection loudness time gap 524 can be 80 ms. The lengths of the time gaps 520, 522, and 524 provided here are for illustration purposes and not meant to be limiting.

Any given virtual reality scene can have multiple sound sources and/or multiple listeners. The multiple sound sources (or a single sound source) can emit overlapping sound. For example, a first sound source may emit a first sound for which reflections are arriving at a listener while the initial sound of a second sound source is arriving at the same listener. Each of these sounds can warrant a separate sound wave propagation field (FIG. 2). The scenario can be further complicated when considering that sound sources and listeners can move about a virtual reality scene. Each new location of sound sources and listeners can also warrant a new sound wave propagation field.

To summarize, proper modeling of the initial sounds and the multiply-scattered reflections and/or reverberations propagating around a complex scene can greatly improve the realness of rendered sound. In some cases, modeling of complex sound can include accurately presenting the timing, directionality, and/or loudness of the sound as it arrives at a listener. Realistic timing, directionality, and/or loudness of sound, based on scene geometry, can be used to build the richness and/or fullness that can help convince a listener that they are immersed in a virtual reality world. Modeling and/or rendering the ensuing acoustic complexity can present a voluminous technical problem. A system for accomplishing modeling and/or rendering of the acoustic complexity is described below relative to FIG. 6.

First Example System

Figure 6:
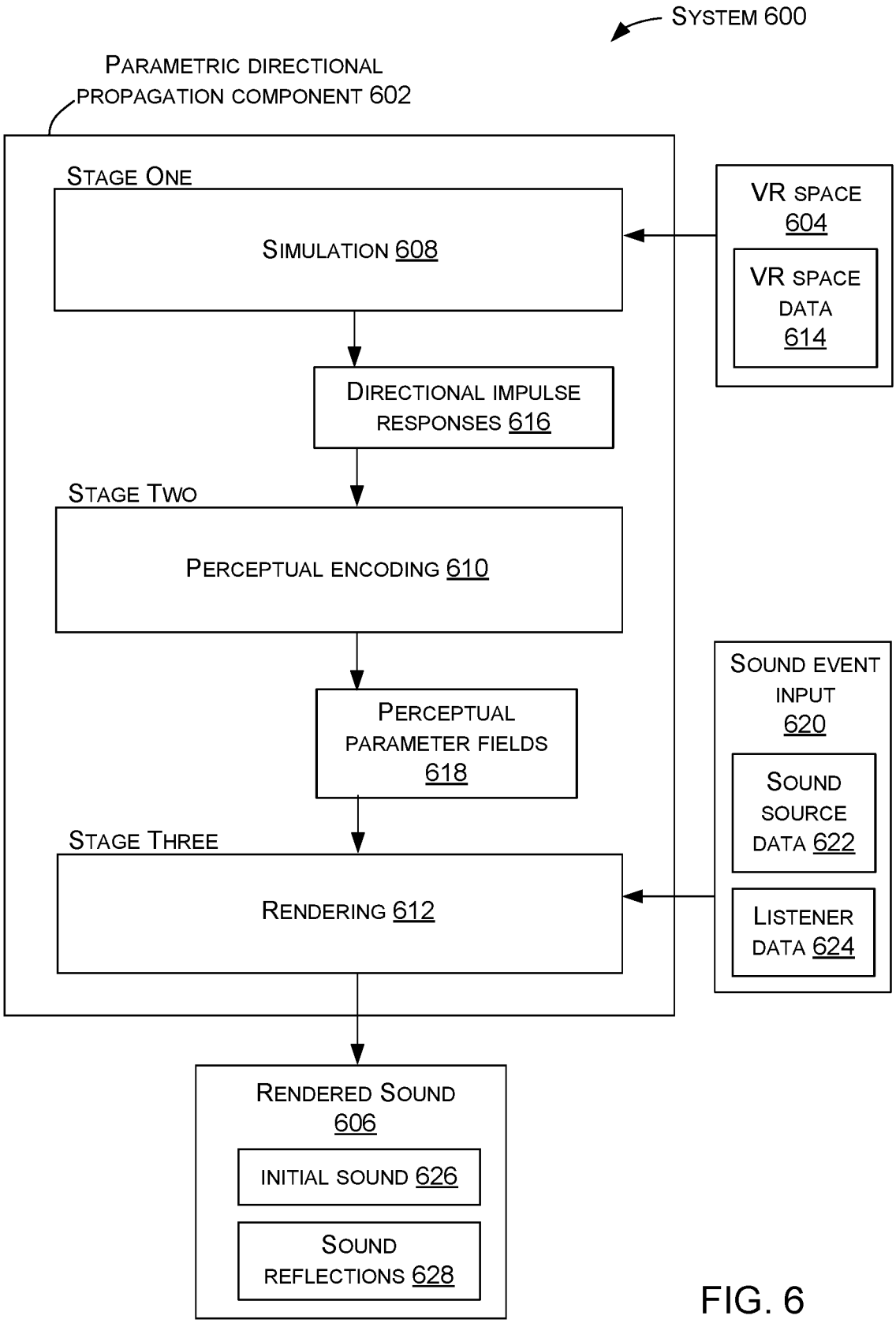
FIGS. 6 and 12 illustrate example parametric directional propagation systems that are consistent with some implementations of the present concepts.

A first example system 600 of parametric directional propagation concepts is illustrated in FIG. 6. System 600 is provided as a logical organization scheme in order to aid the reader in understanding the detailed material in the following sections.

In this example, system 600 can include a parametric directional propagation component 602. The parametric directional propagation component 602 can operate on a virtual reality (VR) space 604. In system 600, the parametric directional propagation component 602 can be used to produce realistic rendered sound 606 for the virtual reality space 604. In the example shown in FIG. 6, functions of the parametric directional propagation component 602 can be organized into three Stages. For instance, Stage One can relate to simulation 608, Stage Two can relate to perceptual encoding 610, and Stage Three can relate to rendering 612. Also shown in FIG. 6, the virtual reality space 604 can have associated virtual reality space data 614. The parametric directional propagation component 602 can also operate on and/or produce directional impulse responses 616, perceptual parameter fields 618, and sound event input 620, which can include sound source data 622 and/or listener data 624 associated with a sound event in the virtual reality space 604. In this example, the rendered sound 606 can include rendered initial sound(s) 626 and/or rendered sound reflections 628.

As illustrated in the example in FIG. 6, at simulation 608 (Stage One), parametric directional propagation component 602 can receive virtual reality space data 614. The virtual reality space data 614 can include geometry (e.g., structures, materials of objects, etc.) in the virtual reality space 604, such as geometry 111 indicated in FIG. 1A. For instance, the virtual reality space data 614 can include a voxel map for the virtual reality space 604 that maps the geometry, including structures and/or other aspects of the virtual reality space 604. In some cases, simulation 608 can include directional acoustic simulations of the virtual reality space 604 to precompute sound wave propagation fields. More specifically, in this example simulation 608 can include generation of directional impulse responses 616 using the virtual reality space data 614. Directional impulse responses 616 can be generated for initial sounds and/or sound reflections. (Directional impulse responses will be described in more detail relative to FIGS. 7A-7C, below.) Stated another way, simulation 608 can include using a precomputed wave-based approach (e.g., pre-computed wave technique) to capture the complexity of the directionality of sound in a complex scene.

In some cases, the simulation 608 of Stage One can include producing relatively large volumes of data. For instance, the directional impulse responses 616 can be nine-dimensional (9D) directional response functions associated with the virtual reality space 604. For instance, referring to the example in FIG. 1A, the 9 dimensions can be 3 dimensions relating to the position of sound source 104 in environment 100, 3 dimensions relating to the position of listener 106, a time dimension (see the x-axis in the example shown in FIG. 5), and 2 dimensions relating to directionality of the incoming initial sound wavefront 110A(2) to the listener 106. In some cases, capturing the complexity of a virtual reality space in this manner can lead to generation of petabyte-scale wave fields. This can create a technical problem related to data processing and/or data storage. Parametric directional propagation concepts can include techniques for solutions for reducing data processing and/or data storage, example of which are provided below.

In some implementations, a number of locations within the virtual reality space 604 for which the directional impulse responses 616 are generated can be reduced. For example, directional impulse responses 616 can be generated based on potential listener locations (e.g., listener probes, player probes) scattered at particular locations within virtual reality space 604, rather than at every location (e.g., every voxel). The potential listener locations can be viewed as similar to listener location 124 in FIG. 1A and/or listener location 422 in FIG. 4. The potential listener locations can be automatically laid out within the virtual reality space 604 and/or can be adaptively-sampled. For instance, potential listener locations can be located more densely in spaces where scene geometry is locally complex (e.g., inside a narrow corridor with multiple portals), and located more sparsely in a wide-open space (e.g., outdoor field or meadow). Similarly, potential sound source locations (such as 122A and 122B in FIGS. 1A and 1B) for which directional impulse responses 616 are generated can be located more densely or sparsely as scene geometry permits. Reducing the number of locations within the virtual reality space 604 for which the directional impulse responses 616 are generated can significantly reduce data processing and/or data storage expenses in Stage One.

In some cases, a geometry of virtual reality space 604 can be dynamic. For example, a door in virtual reality space 604 might be opened or closed, or a wall might be blown up, changing the geometry of virtual reality space 604. In such examples, simulation 608 can receive updated virtual reality space data 614. Solutions for reducing data processing and/or data storage in situations with updated virtual reality space data 614 can include precomputing directional impulse responses 616 for some situations. For instance, opening and/or closing a door can be viewed as an expected and/or regular occurrence in a virtual reality space 604, and therefore representative of a situation that warrants modeling of both the opened and closed cases. However, blowing up a wall can be an unexpected and/or irregular occurrence. In this situation, data processing and/or data storage can be reduced by re-computing directional impulse responses 616 for a limited portion of virtual reality space 604, such as the vicinity of the blast. A weighted cost benefit analysis can be considered when deciding to cover such environmental scenarios. For instance, door opening and closing may be relatively likely to happen in a game scenario and so a simulation could be run for each condition in a given implementation. In contrast, a likelihood of a particular section of wall being exploded may be relatively low, so simulations for such scenarios may not be deemed worthwhile for a given implementation.

Note that instead of computing directional impulse responses for these dynamic scenarios, some implementations can employ other approaches. For instance, a directional impulse response can be computed with the door closed. The effects of the wall can then be removed to cover the open door scenario. In this instance, in a very high level analogy, the door material may have a similar effect on sound signals as five feet of air space, for example. Thus, to cover the open door condition, the path of the closed door directional impulse responses could be 'shortened' accordingly to provide a viable approximation of the open door condition. In another instance, directional impulse responses can be computed with the door opened. Subsequently, to cover the closed door condition, a portion of initial sound(s) and/or reflections that come from locations on the other side of the now-closed doorway from the listener can be subtracted from and/or left out of a corresponding rendered sound for this instance.

As shown in FIG. 6, at Stage Two, perceptual encoding 610 can be performed on the directional impulse responses 616 from Stage One. In some implementations, perceptual encoding 610 can work cooperatively with simulation 608 to perform streaming encoding. In this example, the perceptual encoding process can receive and compress individual directional impulse responses 616 as they are being produced by simulation 608. Using streaming encoding techniques can therefore reduce storage expense associated with simulation 608. As such, streaming encoding can allow feasible precomputation on large video game scenes, even up to 1 kHz, for instance.

In some cases, perceptual encoding 610 can use parametric encoding techniques. Parametric encoding techniques can include selective compression by extracting a few salient parameters from the directional impulse responses 616. In one example, the selected parameters can include 9 dimensions (e.g., 9D parameterization). In this case, parametric encoding can efficiently compress a corresponding 9D directional impulse response function (e.g., the directional impulse responses 616). For example, compression can be performed within a budget of ~100 MB for large scenes, while capturing many salient acoustic effects indoors and outdoors. Stated another way, perceptual encoding 610 can compress the entire corresponding 9D spatially-varying directional impulse response field, and exploit the associated spatial coherence via transformation to directional parameters. A result can be a manageable data volume in the perceptual parameter fields 618 (such as the encoded directional impulse response field 200 described above relative to FIG. 2). In some cases, perceptual encoding 610 can include storage of the perceptual parameter fields 618, such as in a compact data file. Stated another way, a data file storing perceptual parameter fields 618 can characterize precomputed acoustical properties for the virtual reality space 604.

Perceptual encoding 610 can also apply parameterized encoding to reflections of sound. For example, parameters for encoding reflections can include delay and direction of sound reflections. The direction of the sound reflections can be simplified by coding in terms of several coarse directions (such as 6 coarse directions) related to a 3D world position (e.g., "above", "below", "right", "left", "front", and "back" of a listener, described in more detail below relative to FIG. 11). (It is contemplated that more or fewer directions could be utilized in other implementations. For instance, the two positions 'right' and 'front' could be characterized as three positions: 'right,' 'front,' and 'right-front'). The parameters for encoding reflections can also include a decay time of the reflections, similar to decay time 512 described above relative to FIG. 5. For instance, the decay time can be a 60 dB decay time of sound response energy after an onset of sound reflections.

Additional examples of parameters that could be considered with perceptual encoding 610 are contemplated. For example, frequency dependence, density of echoes (e.g., reflections) over time, directional detail in early reflections, independently directional late reverberations, and/or other parameters could be considered. An example of frequency dependence can include a material of a surface affecting the sound response when a sound hits the surface (e.g., changing properties of the resultant reflections). In some cases, arrival directions in the directional impulse responses 616 can be independent of frequency. Such independence can persist in the presence of edge diffraction and/or scattering. Stated another way, for a given source and listener position, energy of a directional impulse response in any given transient phase of the sound response can come from a consistent set of directions across frequency. Of course, in other implementations parameter selection can include a sound frequency dependence parameter.

As shown in FIG. 6, at Stage Three, rendering 612 can utilize the perceptual parameter fields 618 to render sound from a sound event. As mentioned above, the perceptual parameter fields 618 can be obtained in advance and stored, such as in the form of a data file. Rendering 612 can include decoding the data file. When a sound event in the virtual reality space 604 is received, it can be rendered using the decoded perceptual parameter fields 618 to produce rendered sound 606. The rendered sound 606 can include an initial sound(s) 626 and/or sound reflections 628, for example.

In general, the sound event input 620 shown in FIG. 6 can be related to any event in the virtual reality space 604 that creates a response in sound. For example, a response to a person walking may be footstep sounds, an audience reacting may result in a cheering sound, or a detonating grenade may create an explosion sound. Various types of sound event input 620 are contemplated. For instance, the sound source data 622 could be associated with sound source 104 depicted in FIG. 1A. Similarly, the listener data 624 could be associated with listener 106 depicted in FIG. 1A. The sound source data 622 can be related to a single sound source and/or multiple sound sources, and can include information related to sound loudness. The sound source data 622 and the listener data 624 can provide 3D locations of the sound source(s) and the listener, respectively. The examples of sound event input 620 described here are for illustration purposes and are not meant to be limiting.

In some implementations, rendering 612 can include use of a lightweight signal processing algorithm. The lightweight signal processing algorithm can apply directional impulse response filters for the sound source in a manner that can be largely computationally cost-insensitive to a number of the sound sources. For example, the parameters used in Stage Two can be selected such that the number of sound sources processed in Stage Three does not linearly increase processing expense. Lightweight signal processing algorithms are discussed in greater detail below related to FIG. 11.

The parametric directional propagation component 602 can operate on a variety of virtual reality spaces 604. For instance, some examples of a video-game type virtual reality space 604 have been provided above. In other cases, virtual reality space 604 can be an augmented conference room that mirrors a real-world conference room. For example, live attendees could be coming and going from the real-world conference room, while remote attendees log in and out. In this example, the voice of a particular live attendee, as rendered in the headset of a remote attendee, could fade away as the live attendee walks out a door of the real-world conference room.

In other implementations, animation can be viewed as a type of virtual reality scenario. In this case, the parametric directional propagation component 602 can be paired with an animation process, such as for production of an animated movie. For instance, as visual frames of an animated movie are generated, virtual reality space data 614 could include geometry of the animated scene depicted in the visual frames. A listener location could be an estimated audience location for viewing the animation. Sound source data 622 could include information related to sounds produced by animated subjects and/or objects. In this instance, the parametric directional propagation component 602 can work cooperatively with an animation system to model and/or render sound to accompany the visual frames.

In another implementation, parametric directional propagation concepts can be used to complement visual special effects in live action movies. For example, virtual content can be added to real world video images. In one case, a real world video can be captured of a city scene. In post-production, virtual image content can be added to the real world video, such as a virtual car skidding around a corner of the city scene. In this case, relevant geometry of the buildings surrounding the corner would likely be known for the post-production addition of the virtual image content. Using the known geometry (e.g., virtual reality space data 614) and a position and loudness of the virtual car (e.g., sound event input 620), the parametric directional propagation component 602 can provide immersive audio corresponding to the enhanced live action movie. For instance, sound of the virtual car can be made to fade away correctly as it rounds the corner, and the sound direction can be spatialized correctly with respect to the corner as the virtual car disappears from view.

Overall, the parametric directional propagation component 602 can model acoustic effects for arbitrarily moving listener and/or sound sources that can emit any sound signal. The result can be a practical system that can render convincing audio in real-time. Furthermore, the parametric directional propagation component 602 can render convincing audio for complex scenes while solving a previously intractable technical problem of processing petabyte-scale wave fields. As such, parametric directional propagation concepts can handle large, complex 3D scenes within practical RAM and/or CPU budgets. The result can be a practical, fraction-of-a-core CPU system that can produce convincing sound for video games and/or other virtual reality scenarios in real-time.

Second Example Scenario

Figure 7A:
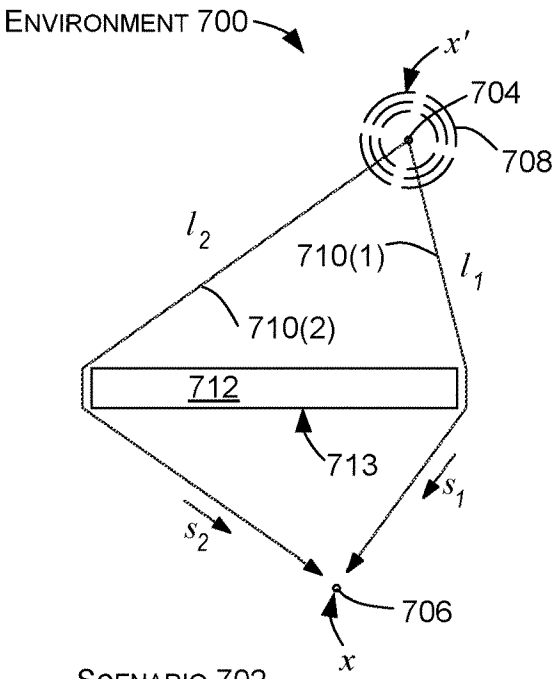
Figure 7B:
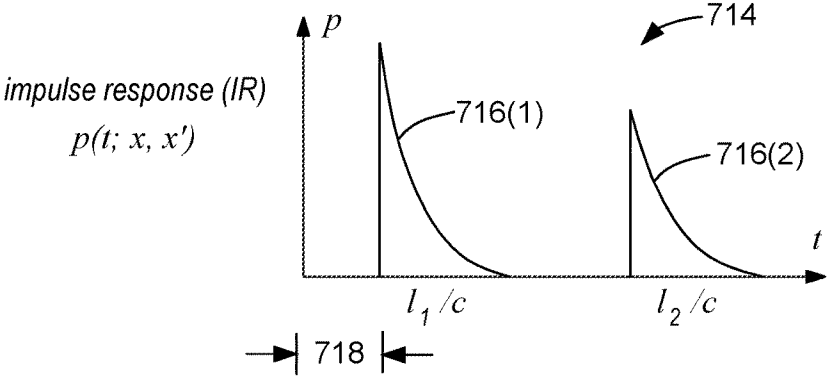
Figure 7C:
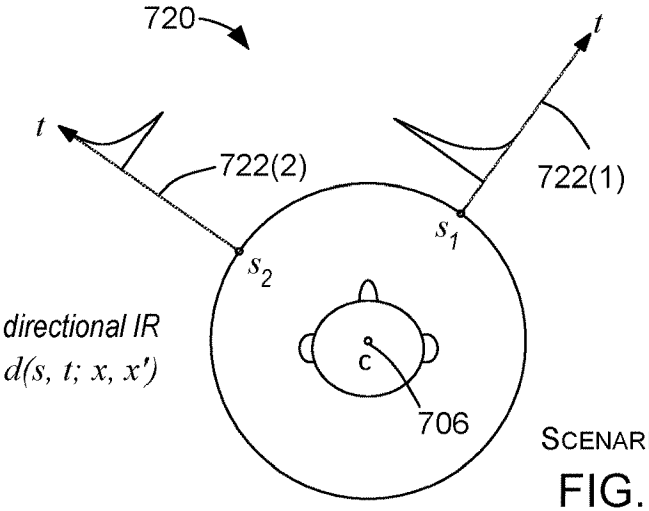

FIGS. 7A-7C are intended to aid understanding of the parametric directional propagation concepts in the following sections. For instance, FIGS. 7A-7C introduce some of the annotation used in the following sections. Description of concepts depicted in FIGS. 7A-7C that are similar to concepts depicted in FIGS. 1A-5 will not be repeated for sake of brevity. The example scenario 702 provided in FIGS. 7A-7C is meant to assist the reader and not meant to be limiting.

FIG. 7A shows an example environment 700, and FIGS. 7A-7C collectively illustrate an example scenario 702, depicting parametric directional propagation concepts. As shown in FIG. 7A, scenario 702 can include a sound source 704, a listener 706, a pulse 708, initial sound wavefronts 710, and a wall 712. In this case wall 712 can act as an occluder 713.

In FIG. 7A, the location of the sound source 704 can be denoted as x' for use in the following equations. Also, the location of the listener 706 can be denoted as x in the following equations. In the example illustrated in FIG. 7A, two diffracted initial sound wavefronts 710 are shown leaving the sound source 704 and propagating to the listener 706 around wall 712. Initial sound wavefront 710(1) arrives at listener 706 from direction $s_1$, while initial sound wavefront 710(2) arrives at listener 706 from direction $s_2$. Initial sound wavefronts 710(1) and 710(2) also have respective associated loudnesses $l_1$ and $l_2$.

In FIG. 7B, graph 714 shows resulting impulse responses (IR) 716 for the initial sound wavefronts 710 of scenario 702. The x-axis of graph 714 is time and the y-axis is pressure deviation (e.g., loudness), similar to graph 500 in FIG. 5. The speed of sound is represented by c. Note that impulse response 716(1) arrives earlier and has a louder sound than impulse response 716(2). Also, graph 714 depicts a delay 718 between the occurrence of the sound event, which is at the origin of graph 714, and impulse response 716(1). As such, the impulse responses 716 can be represented as p(t; x, x'), accounting for time as well as locations of the sound source 704 and the listener 706.

In FIG. 7C, diagram 720 shows corresponding directional impulse responses (DIR) 722. The directional impulse responses 722 can be considered to parameterize the impulse responses 716 in terms of both time and direction. For example, diagram 720 shows that 716(1) is received first, from direction $s_1$, while 716(2) is received later, from direction $s_2$. For instance, in FIG. 7C directional impulse response 722(1) is shown arriving at the front right side of listener 706, while directional impulse response 722(2) is shown arriving at the front left side of listener 706. As such, the directional impulse responses 722 can be represented as p(s, t; x, x'), accounting for time, the locations of the sound source 704 and the listener 706, and also adding the direction of the incoming sound, s.

Green's Function and the DIR Field

In some implementations, sound propagation can be represented in terms of Green's function, p, representing pressure deviation satisfying the wave equation:

$$\left[\frac{1}{c^2}\frac{\partial^2}{\partial t^2} - \nabla^2\right] p(t, x, x') = \delta(t)\delta(x - x') \tag{1}$$

where c=340 m/s can be the speed of sound and δ the Dirac delta function representing a forcing impulse of the partial differential equation (PDE). Holding (x,x') fixed, p(t; x, x') can yield the impulse response at a 3D receiver point x due to a spatio-temporal impulse introduced at point x'. Thus, p can form a 6D field of impulse responses capturing global propagation effects, like scattering and diffraction. The global propagation effects can be determined by the boundary conditions which comprise the geometry and materials of a scene. In nontrivial scenes, analytical solutions may be unavailable and p can be sampled via computer simulation and/or real-world measurements. The principle of acoustic reciprocity can suggest that under fairly general conditions, Green's function can be invariant to interchange of source and receiver: p(t, x, x')=p(t, x', x).

In some implementations, focus can be placed on omnidirectional point sources, for example. A response at x due to a source at x' emitting a pressure signal $\tilde{q}(t)$ can be recovered from Green's function via a temporal convolution, denoted by *, as $$q(t;x,x')=\tilde{q}(t)*p(t;x,x') \tag{2}$$

In some cases, p(t; x, x') in any finite, source-free region centered at x can be uniquely expressed as a sum of plane waves, which can form a complete (e.g., near-complete) basis for free-space propagation. The result can be a decomposition into signals propagating along plane wavefronts arriving from various directions, which can be termed the directional impulse response (DIR) (see FIG. 7C). Applying the decomposition at each (x,x') can yield the directional impulse response field, denoted d(s,t; x, x'), where s parameterizes arrival direction. The DIR field can be computed and/or compactly encoded so that it can be perceptually reproduced for virtually any number of sound sources and associated signals. Furthermore, the computing and encoding can be performed efficiently at runtime.

Binaural Rendering with the HRTF

The response of an incident plane wave field δ(t+s·Δx/c) from direction s can be recorded at the left and right ears of a listener (e.g., user, person). Δx denotes position with respect to the listener's head centered at x. Assembling this information over all directions can yield the listener's Head-Related Transfer Function (HRTF), denoted $h^{L/R}$ (s, t). Low-to-mid frequencies (<1000 Hz) correspond to wavelengths that can be much larger than the listener's head and can diffract around the head. This can create a detectable time difference between the two ears of the listener. Higher frequencies can be shadowed, which can cause a significant loudness difference. These phenomena, respectively called the interaural time difference (ITD) and the interaural level difference (ILD), can allow localization of sources. Both can be considered functions of direction as well as frequency, and can depend on the particular geometry of the listener's pinna, head, and/or shoulders.

Given the HRTF, rotation matrix R mapping from head to world coordinate system, and the DIR field absent the listener's body, binaural rendering can reconstruct the signals entering the two ears, $q^{L/R}$, via $$q^{L/R}(t;x,x')=\tilde{q}(t)*p^{L/R}(t;x,x') \tag{3}$$

where $p^{L/R}$ can be the binaural impulse response $$p^{L/R}(t;x,x')=\int_{S^2} d(s,t;x,x')*h^{L/R}(R^{-1}(s),t)ds \tag{4}$$

Here $S^2$ indicates the spherical integration domain and ds the differential area of its parameterization, $s \in S^2$. Note that in audio literature, the terms "spatial" and "spatialization" can refer to directional dependence (on s) rather than source/listener dependence (on x and x').

A generic HRTF dataset can be used, combining measurements across many subjects. For example, binaural responses can be sampled for $N_H$=2048 discrete directions $\{s_j\}$, $j \in [0, N_H-1]$ uniformly spaced over the sphere. Other examples of HRTF datasets are contemplated for use with the present concepts.

Directional Acoustic Perception

This section provides a description of human auditory perception relevant to parametric directional propagation concepts, with reference to scenario 702 illustrated in FIGS. 7A-7C. In some cases, the directional impulse response (DIR) can be divided into three successive phases in time: initial arrivals, followed by early reflections, which smoothly transition into late reverberations.

Precedence. In the presence of multiple wavefront arrivals carrying similar temporal signals, human auditory perception can non-linearly favor the first to determine the primary direction of the sound event. This can be called the precedence effect. Referring to FIG. 7B, if the mutual delay $(l_2-l_1)/c$ is less than 1 ms, for example, humans can perceive a direction intermediate between the two arrivals, termed summing localization, which can represent the temporal resolution of directional hearing. Directions from arrivals lagging beyond 1 ms can be strongly suppressed. In some cases, these arrivals may need to be as much as 10 dB louder to move the perceived direction significantly, called the Haas effect.

Extracting the correct direction for the potentially weak and multiply-diffracted first arrival thus can be critical for faithfully rendering perceived direction of the sound event. Directionality of the first arrival can form the primary cue guiding the listener to visually occluded sound sources. Parametric directional propagation concepts, such as perceptual encoding 610 introduced relative to FIG. 6, can be designed to extract the onset time robustly. For example, parametric directional propagation concepts can use a short window after onset, such as 1 ms, to integrate the first arrival direction.

Panning. Summing localization can be exploited by traditional speaker amplitude panning, which can play the same signal from multiple (e.g., four to six) speakers surrounding the physical listener. By manipulating the amplitude of each signal copy, for example, the perceived direction can move smoothly between the speakers. In some cases, summing localization can be exploited to efficiently encode and render directional reflections.

Echo threshold. When a sound follows the initial arrival after a delay, called the echo threshold, the sound can be perceived as a separate event; otherwise the sound is fused. For example, the echo threshold can vary between 10 ms for impulsive sounds, through 50 ms for speech, to 80 ms for orchestral music. Fusion can be accomplished conservatively by using a 10 ms window, for instance, to aggregate loudness for initial arrivals.

Initial time delay gap. In some cases, initial arrivals can be followed by stronger reflections. Stronger reflections can be reflected off big features like walls. Stronger reflections can also be mixed with weaker arrivals scattered from smaller, more irregular geometry. If the first strong reflection arrives beyond the echo threshold, its delay can become audible. The delay can be termed the initial time delay gap, which can have a perceptual just-noticeable-difference of about 10 ms, for example. Audible gaps can arise easily, such as when the source and listener are close, but perhaps far from surrounding geometry. Parametric directional propagation concepts can include a fully automatic technique for extracting this parameter that produces smooth fields. In other implementations, this parameter can be extracted semi-manually, such as for a few responses.

Reflections. Once reflections begin arriving, they can typically bunch closer than the echo threshold due to environmental scattering, and/or can be perceptually fused. A value of 80 ms, for example, following the initial time delay gap, can be used as the duration of early reflections. An aggregate directional distribution of the reflections can convey important detail about the environment around the listener and/or the sound source. The ratio of energy arriving horizontally and perpendicular to the initial sound is called lateralization and can convey spaciousness and apparent source width. Anisotropy in reflected energy arising from surfaces close to the listener can provide an important proximity cue. When a sound source and listener are separated by a portal, reflected energy can arrive mostly through the portal and can be strongly anisotropic, localizing the source to a different room than that of the listener. This anisotropy can be encoded in the aggregate reflected energy.

Reverberation. As time progresses, scattered energy can become weaker. Also, scattered energy can arrive more frequently so that the tail of the response can resemble decaying noise. This can characterize the (late) reverberation phase. A decay rate of this phase can convey overall scene size, which can be measured as RT60, or the time taken for energy to decay by 60 dB. The aggregate directional properties of reverberation can affect listener "envelopment". In some cases, the problem can be simplified by assuming that the directional distribution of reverberation is the same as that for reflections.

Additional Example Implementations

Additional example implementations of parametric directional propagation concepts are described below and illustrated in FIGS. 8A-11. In these additional example implementations, the parametric directional propagation concepts are organized into Stage One, Stage Two, and Stage Three as introduced in FIG. 6. The organization of the parametric directional propagation concepts in this manner is simply to aid the reader and is not meant to be limiting.

Stage One—Simulation

The additional example implementations described in this section can be similar to the Stage One parametric directional propagation concepts shown in FIG. 6. For example, additional example implementations described here can include examples of simulation 608. In some cases, simulation 608 can include performing directional analysis of sound fields. One example of directional analysis of sound fields can include plane wave decomposition (PWD), described below. Another example of directional analysis of sound fields, acoustic flux density, will also be described.

Plane Wave Decomposition (PWD)

The annotation in this section follows the annotation introduced above relative to FIGS. 7A-7C. In some implementations, $\Delta x$ can denote relative position in a volume centered around the listener at x where the local pressure field is to be directionally analyzed. For any source position x' (hereafter dropped), the local IR field can be denoted by $p(\Delta x,t)$ and the Fourier transform of the time-dependent signal for each $\Delta x$ by $P(\Delta x, \omega) \equiv F[p(\Delta x, t)]$. In general, the $\int$ Fourier transform of g(t) can be denoted as $G(\omega) \equiv F[g(t)] \equiv \int_{-\infty}^{\infty} g(t)e^{i\omega t}\,dt$, assuming time-harmonic dependence of the form $e^{-i\omega t}$. Angular frequency $\omega$ can be dropped from the notation in the following; the directional analysis we describe can be performed for each value of $\omega$. In some cases, parameterizing in terms of spherical coordinates, $\Delta x = rs(\theta, \phi)$ where $s(\theta, \phi) \equiv (\sin\theta\cos\phi, \sin\theta\sin\phi, \cos\phi)$ represents a unit direction and $r \equiv \|\Delta x\|$. This coordinate system can yield orthogonal solutions (modes) of the Helmholtz equation, which can allow representation of the solution P in any source-free region via $$P(\Delta x) = \Sigma_{l,m} P_{l,m} b_l(Kr) Y_{l,m}(s) \tag{5}$$

where the mode coefficients $P_{l,m}$ can determine the field, perhaps uniquely. The function $b_l$ can be the (real-valued) spherical Bessel function; $K \equiv \omega/c \equiv 2\pi v/c$ can be the wavenumber where v is the frequency. The notation $\Sigma_{l,m} \equiv \Sigma_{l=0}^{-1} \Sigma_{m=-1}^{1}$ can indicate a sum over all integer modes where $l \in [0, n-1]$ can be the order, $m \in [-1,1]$ can be the degree, and n can be the truncation order. Lastly, $Y_{l,m}$ can be the $n^2$ complex spherical harmonic (SH) basis functions defined as $$Y_{l,m}(s) \equiv \sqrt{\frac{2l+1}{4\pi}\frac{(1-m)!}{(l+m)!}}\, P_{l,m}(\cos\theta)e^{im\phi} \tag{6}$$

where $P_{l,m}$ can be the associated Legendre function.

Diffraction limit. The sound field can be observed by an ideal microphone array within a spherical region $\|\Delta x\| \le r_0$ which can be free of sources and boundary. The mode coefficients can be estimated by inverting the linear system represented by Equation (5) to find the unknown (complex) coefficients $P_{l,m}$ in terms of the known (complex) coefficients of the sound field, $P(\Delta x)$. The angular resolution of any wave field sensor can be fundamentally restricted by the size of the observation region, which can be the diffraction limit. This manifests mathematically as an upper limit on the SH order n dependent on $r_0$ which can keep the linear system well-conditioned.

Such analysis can be standard in fast multipole methods for 3D wave propagation and/or for processing output of spherical microphone arrays. In some cases, compensation can be made for the scattering that real microphone arrays introduce in the act of measuring the wave field. Synthetic cases can avoid these difficulties since "virtual microphones" can simply record pressure without scattering. Directional analysis of sound fields produced by wave simulation has previously been considered a difficult technical problem. One example solution can include low-order decomposition. Another example solution can include high-order decomposition that can sample the synthetic field over the entire 3D volume $\|\Delta x\| \le r_0$ rather than just its spherical surface, estimating the modal coefficients $P_{l,m}$ via a least-squares fit to the over-determined system, see Equation (5).

In some implementations, a similar technique can be followed, using a frequency-dependent SH truncation order of $$n(\omega, r_0) \equiv \left\lceil \frac{Kr_0 e}{2} \right\rceil \tag{7}$$

where e≡exp(1).

Solution In some cases, regularization can be unnecessary. For example, a selected solver can be different from finite-difference time-domain (FDTD). In some cases, the linear system in Equation (5) can be solved using QR decomposition to obtain $P_{l,m}$. This recovers the (complex) directional amplitude distribution of plane waves that (potentially) best matches the observed field around x, known as the plane wave decomposition, $$D_{l,m} = \frac{i^l}{4\pi} P_{l,m} \tag{8}$$

Assembling these coefficients over all co and/or transforming from frequency to time domain can reconstruct the directional impulse response (DIR)=$F^{-1}$ [D(s,ω)] where $$D(s,\omega) \equiv \Sigma_{l,m} D_{l,m}(\omega) Y_{l,m}(s) \tag{9}$$

Binaural impulse responses for a PWD reference can be generated by Equation (4), performing convolution in frequency space. For each angular frequency ω, the spherical integral can be computed, multiplying the frequency-space PWD with each of the $N_H$ (e.g., 2048) spherical HRTF responses transformed to the frequency domain via $$p^{L/R}(\omega) = \Sigma_{j=0}^{N_H-1} D(R(s_j),\omega) H^{L/R}(s_j,\omega) \tag{10}$$

where $H^{L/R} \equiv F[h^{L/R}]$ and $P^{L/R} \equiv F[p^{L/R}]$, followed by a transform to the time domain to yield $p^{L/R}(t)$.

Acoustic Flux Density

In some cases, directional analysis of sound fields can be performed using acoustic flux density to construct directional impulse responses. For example, suppressing source location x, the impulse response can be a function of receiver location and time representing (scalar) pressure variation, denoted p(x, t). The flux density, f(x, t), can be defined as the instantaneous power transport in the fluid over a differential oriented area, which can be analogous to irradiance in optics. It can follow the relation $$f(x, t) = p(x, t)v(x, t),\ v(x, t) = -\frac{1}{\rho_0}\int_{-\infty}^{t} \nabla p(x, \tau)d\tau \tag{11}$$

where v is the particle velocity and $\rho_0$ is the mean air density (1.225 kg/m$^3$). Central differences on immediate neighbors in the simulation grid can be used to compute spatial derivatives for ∇p, and midpoint rule over simulated steps for numerical time integration.

Flux density (or simply, flux) can estimate the direction of a wavefront passing x at time t. When multiple wavefronts arrive simultaneously, PWD can tease apart their directionality (up to angular resolution determined by the diffraction limit) while flux can be a differential measure, which can merge their directions.

To reconstruct the DIR from flux for a given time t (and suppressing x), the unit vector $\hat{f}(t) \equiv f(t)/\|f(t)\|$ can be formed. The corresponding pressure value p(t) can be associated to that single direction, yielding $$d(s,t) = p(t)\delta(s - \hat{f}(t)) \tag{12}$$

Note that this can be a nonlinear function of the field, unlike Equation (9). Binaural responses can be computed using the spherical integral in Equation (4), for example by plugging in the DIR d(s, t) from Equation (12) and doing a temporal Fourier transform, which can simplify to $$p^{L/R}(\omega) = \int_0^{\infty} p(t)e^{i\omega t} H^{L/R}(R^{-1}(\hat{f}(t)),\omega)dt \tag{13}$$

The time integral can be carried out at the simulation time step, and HRTF evaluations can employ nearest-neighbor lookup. The result can then be transformed back to binaural time-domain impulse responses, which can be used for comparing flux with PWD.

Results using flux for directional analysis of sound fields show that IR directionality can be similar for different frequencies. Consequently, energy over many simulated frequencies can be averaged to save computational expense. Therefore, in some cases relatively little audible detail may be lost when using frequency-independent encoding of directions derived from flux. More detail regarding the use of flux to extract DIR perceptual parameters will be provided relative to the discussion for Stage Two, below.

Precomputation

In some implementations, ordinary restrictions on listener position (such as atop walkable surfaces) can be exploited by reciprocal simulation to significantly shrink precompute time, runtime memory, and/or CPU needs. Such simulation can exchange sound source and/or listener position between precomputation and runtime so that runtime sound source and listener correspond respectively to (x,x') in Equation (1). The first step can be to generate a set of probe points {x} with typical spacing of 3-4 m. For each probe point in {x'}, 3D wave simulation can be performed using a wave solver in a volume centered at the probe (90 m×90 m×30 m in our tests), thus yielding a 3D slice p(x, t; x') of the full 6D field of acoustic responses, for example. In some cases, the constrained runtime listener position can reduce the size of {x'} significantly. This framework can be extended to extract and/or encode directional responses.

Reciprocal Dipole Simulation. Acoustic flux density, or flux (described above), can be used to compute the directional response, which can require the spatial derivative of the pressure field for the runtime listener at x'. But the solver can yield p(x, t; x'); i.e., the field can vary over runtime source positions (x) instead. In some implementations, a solution can include computing flux at the runtime listener location while retaining the benefits of reciprocal simulation. For some grid spacing h, $\nabla_x p(x, x') \approx [P(x; x'+h) - p(x; x'-h)]/2h$ can be computed via centered differencing. Due to the linearity of the wave equation, this can be obtained as response to the spatial impulse $[\delta(x-x'-h) - \delta(x-x'+h)]/2h$. In other words, flux at a fixed runtime listener (x') due to a 3D set of runtime source locations (x) can be obtained by simulating discrete dipole sources at x'. The three Cartesian components of the spatial gradient can require three separate dipole simulations. In some cases, the above argument can extend to higher-order derivative approximations. In other cases, centered differences can be sufficient.

Time integration. To compute particle velocity via Equation (11), the time integral of the gradient $\int_t \nabla p$ can be used, which can commute to $\nabla \int_t p$. Since the wave equation can be linear, $\int_t p$ can be computed by replacing the temporal source factor in Equation (1) with $\int_t \delta(t)=H(t)$, the Heaviside step function. The full source term can therefore be $H(t)[\delta(x-x'+h)-\delta(x-x'-h)]/2\rho_0 h$, for which the output of the solver can directly yield particle velocity, $v(t, x; x')$. The three dipole simulations can be complemented with a monopole simulation with source term $\delta(t)\delta(x-x')$, which can result in four simulations to compute the response fields $\{p(t, x; x'), f(t, x; x')\}$.

Bandlimiting. Discrete simulation can be used to bandlimit the forcing impulse in space and time. The cutoff can be set at $v_m$=1000 Hz, requiring a grid spacing of $h=\frac{3}{8}c\equiv\frac{1}{2}c/vM=12.75$ cm. In some cases, this can discard the highest 25% of the simulation's entire Nyquist bandwidth $v_M$ due to its large numerical error. DCT spatial basis functions in the present solver (adaptive rectangular decomposition can naturally convert delta functions into sincs bandlimited at wavenumber $K=\pi/h$, simply by emitting the impulse at a single discrete cell, for example. The source pulse can also be temporally bandlimited, denoted $\tilde{\delta}(t)$. Temporal source factors can be modified to $\tilde{\delta}(t)$ and $H(t)*\tilde{\delta}(t)$ for the monopole and dipole simulations respectively. Note that $\tilde{\delta}$ will be defined below in the discussion relative to Stage Two. Quadrature for the convolution $H(t)*\tilde{\delta}(t)$ can be precomputed to arbitrary accuracy and input to the solver.

Streaming. In some cases, precomputed wave simulation can use a two stage approach in which the solver writes a massive spatio-temporal wave field to disk which the encoder can then read and process. However, disk I/O can bottleneck the processing of large game scenes, becoming impractical for mid-frequency ($v_m$=1000 Hz) simulations. It also complicates cloud computing and GPU acceleration.

In some implementations, referring to Stage Two (FIG. 6), perceptual encoding 610 can include use of a streaming encoder which can execute entirely in RAM. Processing for each runtime listener location x' can proceed independently across machines. For example, for each x', four instances of the wave solver can be run simultaneously to compute monopole and dipole simulations. The time-domain wave solver can naturally proceed as discrete updates to the global pressure field. At each time step t, 3D pressure and flux fields can be sent in memory to the encoder coprocess which can extract the parameters. The encoder can be single instruction, multiple data (SIMD) across all grid cells, for instance. In some cases, the encoder may not be able to access field values beyond the current simulation time t. In other cases, the entire time response may be available. Furthermore, the encoder can retain intermediate state from prior time steps (such as accumulators); this per-cell state can be minimized to keep RAM requirements practical. In short, the encoder can be causal with limited history. Further details regarding design of an encoder will be provided in the discussion of Stage Two, below.

Cost. In some cases, simulations performed for $v_m$=1000 Hz can have $|\{x\}|$=120 million cells. The total size of the discrete field across a simulation duration of 0.5 s can be 5.5 TB, which could take 30 hours just for disk I/O at 100 MB/s, for example. In contrast, parametric directional propagation concepts can execute in 5 hours taking 40 GB RAM with no disk use. Stated another way, in some cases precomputation using parametric directional propagation concepts at $v_m$=500 Hz can be 3 times faster, despite three additional dipole simulation and/or directional encoding.

Stage Two—Perceptual Encoding

The additional example implementations described in this section can be similar to the Stage Two parametric directional propagation concepts shown in FIG. 6. For example, additional example implementations described here can include examples of perceptual encoding 610.

At each time step t, the encoder can receive $\{p(t,x; x'), f(t,x; x')\}$ representing the pressure and flux at runtime listener x' due to a 3D field of possible runtime source locations, x, for which it performs independent, streaming processing. Positions can be suppressed, as described below.

Notation. In some cases, $t_k \equiv k\Delta t$ denotes the $k^{th}$ time sample with time step $\Delta t$, where $\Delta t$=0.17 ms for $v_m$=1000 Hz. First-order Butterworth filtering with cutoff frequency $v_m$ in Hz can be denoted $\mathcal{L}_v$. A signal g(t) filtered through $\mathcal{L}$ can be denoted $\mathcal{L}*g$. A corresponding cumulative time integral can be denoted $\int g \equiv \int_0^t g(\tau)\, d\tau$.

Equalized Pulse

Figure 8A:
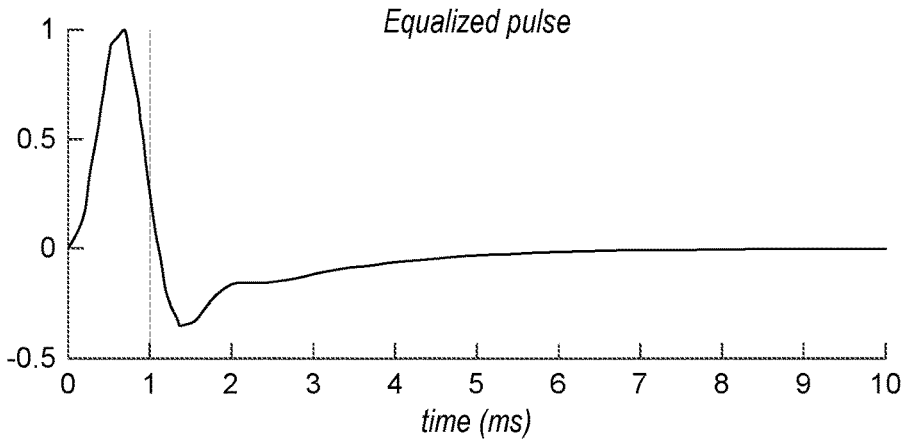
Figure 8B:
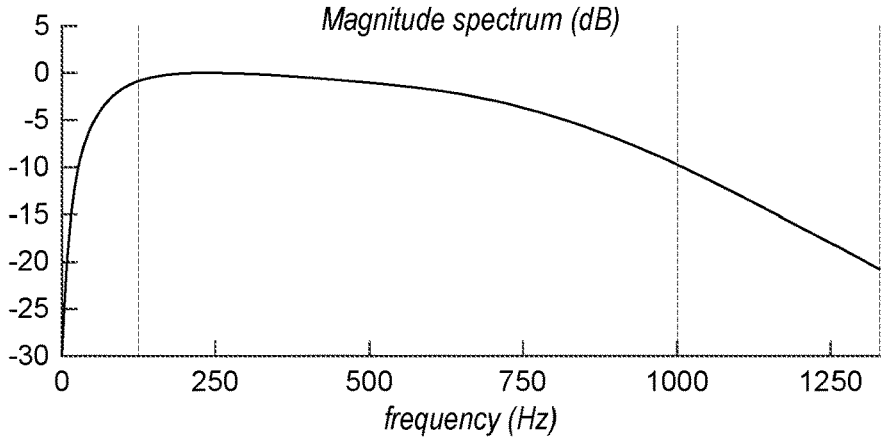
Figure 8C:
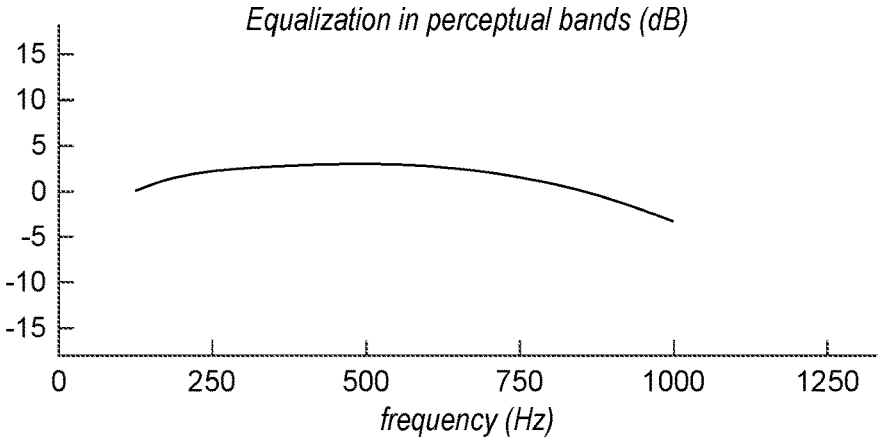

Encoder inputs $\{p(t), f(t)\}$ can be responses to an impulse $\tilde{\delta}(t)$ provided to the solver. In some cases, an impulse function (FIG. 8A-8C) can be designed to conveniently estimate the IR's energetic and directional properties without undue storage or costly convolution. FIG. 8A shows an equalized pulse $\tilde{\delta}(t)$ for $v_l$=125 Hz, $v_m$=1000 Hz and $v_M$=1333 Hz. As shown in FIG. 8A, the pulse can be designed to have a sharp main lobe (e.g., ~1 ms) to match auditory perception. As shown in FIG. 8B, the pulse can also have limited energy outside $[v_l, v_m]$, with smooth falloff which can minimize ringing in time domain. Within these constraints, the pulse can be designed to have matched energy (to within ±3 dB) in equivalent rectangular bands centered at each frequency, as shown in FIG. 8C.

In some implementations, the pulse can satisfy one or more of the following Conditions:

(1) Equalized to match energy in each perceptual frequency band. $\int p^2$ thus directly estimates perceptually weighted energy averaged over frequency.

(2) Abrupt in onset, critical for robust detection of initial arrival. Accuracy of about 1 ms or better, for example, when estimating the initial arrival time, matching auditory perception.

(3) Sharp in main peak with a half-width of less than 1 ms, for example. Flux merges peaks in the time-domain response; such mergers can be similar to human auditory perception.

(4) Anti-aliased to control numerical error, with energy falling off steeply in the frequency range $[v_m, v_M]$.

(5) Mean-free. In some cases, sources with substantial DC energy can yield residual particle velocity after curved wavefronts pass, making flux less accurate. Reverberation in small rooms can also settle to a non-zero value, spoiling energy decay estimation.

(6) Quickly decaying to minimize interference between flux from neighboring peaks. Note that abrupt cutoffs at $v_m$ for Condition (4) or at DC for Condition (5) can cause non-compact ringing.

Human pitch perception can be roughly characterized as a bank of frequency-selective filters, with frequency-dependent bandwidth known as Equivalent Rectangular Bandwidth (ERB). The same notion underlies the Bark psychoacoustic scale consisting of 24 bands equidistant in pitch and utilized by the PWD visualizations described above.

A simple model for ERB around a given center frequency v in Hz is given by $B(v)\equiv 24.7\,(4.37\,v/1000+1)$. Condition (1) above can then be met by specifying the pulse's energy spectral density (ESD) as $1/B(v)$. However, in some cases this can violate Conditions (4) and (5). Therefore, the modified ESD can be substituted $$E(v) = \frac{1}{B(v)} \frac{1}{|1 + 0.55(2iv/v_h) - (v/v_h)^2|^4} \frac{1}{|1 + iv/v_l|^2} \quad (14)$$

where $v_1$=125 Hz can be the low and $v_h$=0.95 $v_m$ the high frequency cutoff. The second factor can be a second-order low-pass filter designed to attenuate energy beyond $v_m$ per Condition (4) while limiting ringing in the time domain via the tuning coefficient 0.55 per Condition (6). The last factor combined with a numerical derivative in time can attenuate energy near DC, as explained more below.

A minimum-phase filter can then be designed with E (v) as input. Such filters can manipulate phase to concentrate energy at the start of the signal, satisfying Conditions (2) and (3). To make DC energy 0 per Condition (5), a numerical derivative of the pulse output can be computed by minimum-phase construction. The ESD of the pulse after this derivative can be $4\pi^2v^2E(v)$. Dropping the $4\pi^2$ and grouping the $v^2$ with the last factor in Equation (14) can yield $v^2/|1+iv/v_l|^2$, representing the ESD of a first-order high-pass filter with 0 energy at DC per Condition (5) and smooth tapering in $[0,v_l]$ which can control the negative side lobe's amplitude and width per Condition (6). The output can be passed through another low-pass $L_{vh}$ to further reduce aliasing, yielding the final pulse shown in FIG. 8A.

Initial Delay (Onset), $\tau_0$

Figure 9A:
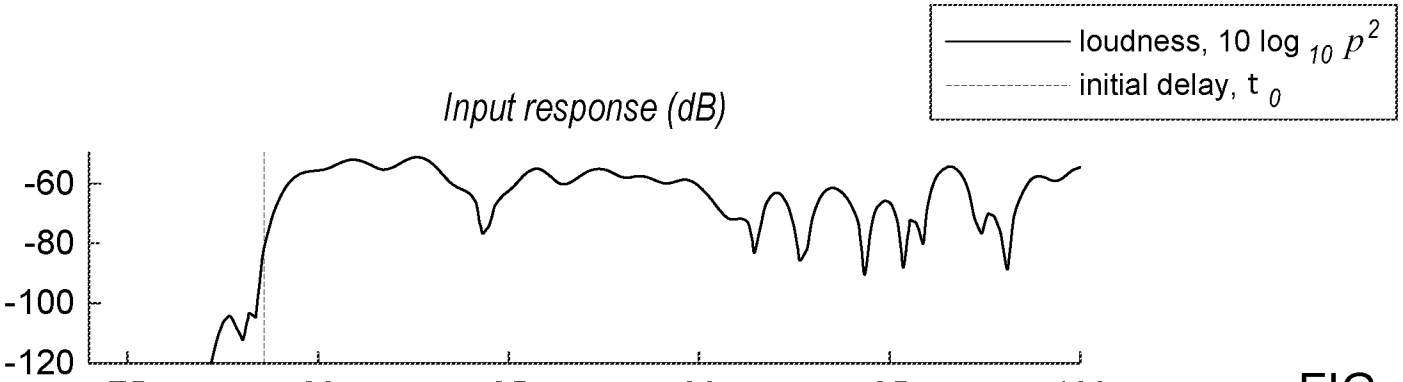
Figure 9B:
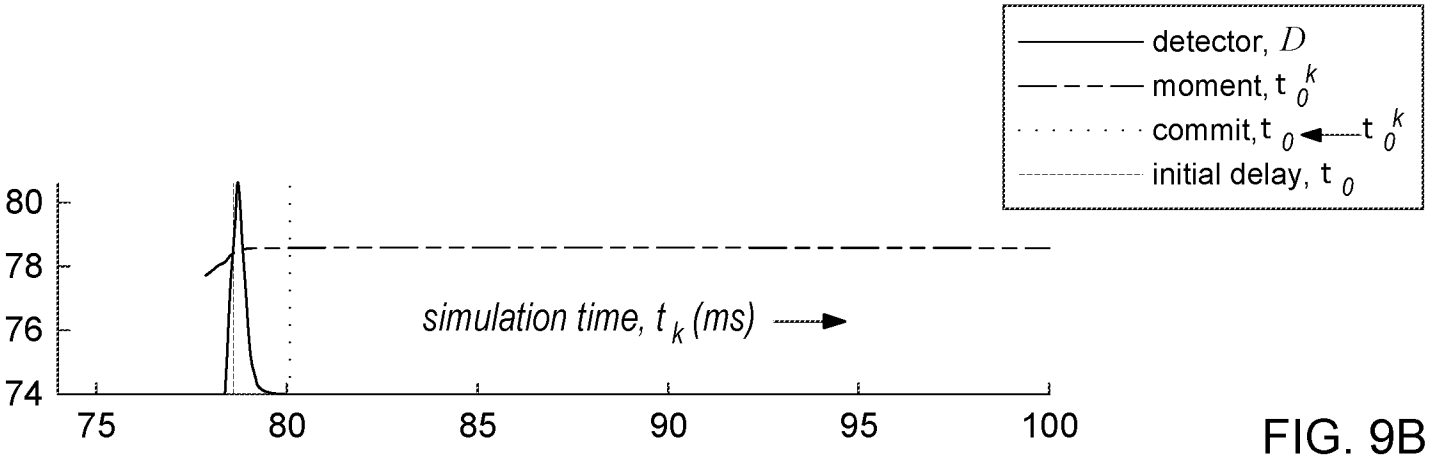

FIGS. 9A and 9B illustrate processing with an actual response from an actual video game scene. Initial delay can be similar to the initial sound delay 514 described relative to FIG. 5, above). The solver can fix the emitted pulse's amplitude so the received signal at 1 m distance (for example) in the free field can have unit energy, $\int p^2=1$. In some cases, initial delay could be computed by comparing incoming energy $p^2$ to an absolute threshold. In other cases, such as occluded cases, a weak initial arrival can rise above threshold at one location and stay below at a neighbor, which can cause distracting jumps in rendered delay and direction at runtime.

In some cases, in a robust detector D, initial delay can be computed as its first moment, $\tau_0 \equiv \int tD(t)/\int D(t)$, where $$D(t) \equiv \left[\frac{d}{dt}\left(\frac{E(t)}{E(t-\Delta t)+\epsilon}\right)\right]^n \quad (15)$$

Here, $E(t) \equiv \mathcal{L}_{vm/4} * \int P^2$ and $\epsilon=10^{-11}$. E can be a monotonically increasing, smoothed running integral of energy in the pressure signal. The ratio in Equation (15) can look for jumps in energy above a noise floor $\epsilon$. The time derivative can then peak at these jumps and descend to zero elsewhere, for example, as shown in FIGS. 9A and 9B. (In FIGS. 9A and 9B, D is scaled to span the y-axis.) In some cases, for the detector to peak, energy can abruptly overwhelm what has been accumulated so far. The detector's peakedness can be controlled using n=2, for example.

This detector can be streamable. $\int p^2$ can be implemented as a discrete accumulator. $\mathcal{L}$ can be a recursive filter, which can use an internal history of one past input and output, for example. One past value of E can be used for the ratio, and one past value of the ratio kept to compute the time derivative via forward differences. However, computing onset via first moment can pose a problem as the entire signal must be processed to produce a converged estimate.

The detector can be allowed some latency, for example 1 ms for summing localization. A running estimate of the moment can be kept, $\tau_0^k=\int_0^{t_k} tD(t)/\int_0^{t_k} D(t)$ and a detection can be committed $\tau_0 \leftarrow \tau_0^k$ when it stops changing; that is, the latency can satisfy $t_{k-1}-\tau_0^{k-1}<1$ ms and $t_k-\tau_0^k>1$ ms (see the dotted line in FIGS. 9A and 9B). In some cases, this detector can trigger more than once, which can indicate the arrival of significant energy relative to the current accumulation in a small time interval. This can allow the last to be treated as definitive. Each commit can reset the subsequent processing state as necessary.

Initial Loudness and Direction, $(L,s_0)$

Initial loudness and its 3D direction can be estimated via $$L \equiv 10 \log_{10} \int_0^{\tau_0''} p^2(t)dt, s_0 \equiv \int_0^{\tau_0'} f(t)dt \quad (16)$$

where $\tau_0'=t_0+1$ ms and $\tau_0''=t_0+10$ ms. In some cases, only the (unit) direction of $s_0$ may be retained as the final parameter. This can assume a simplified model of directional dominance where directions outside a 1 ms window can be suppressed, but their energy can be allowed to contribute to loudness for 10 ms, for instance.

Reflections Delay, $t_1$

Reflections delay can be the arrival time of the first significant reflection. Its detection can be complicated by weak scattered energy which can be present after onset. A binary classifier based on a fixed amplitude threshold can perform poorly. Instead, the duration of silence in the response can be aggregated, where "silence" is given a smooth definition discussed shortly. Silent gaps can be concentrated right after the initial arrivals, but before reflections from surrounding geometry have become sufficiently dense in time from repeated scattering. The combined duration of this silence can be a new parameter roughly paralleling the notion of initial time delay gap (see the reflection delay 516 described relative to FIG. 5, above).

Figure 10A:
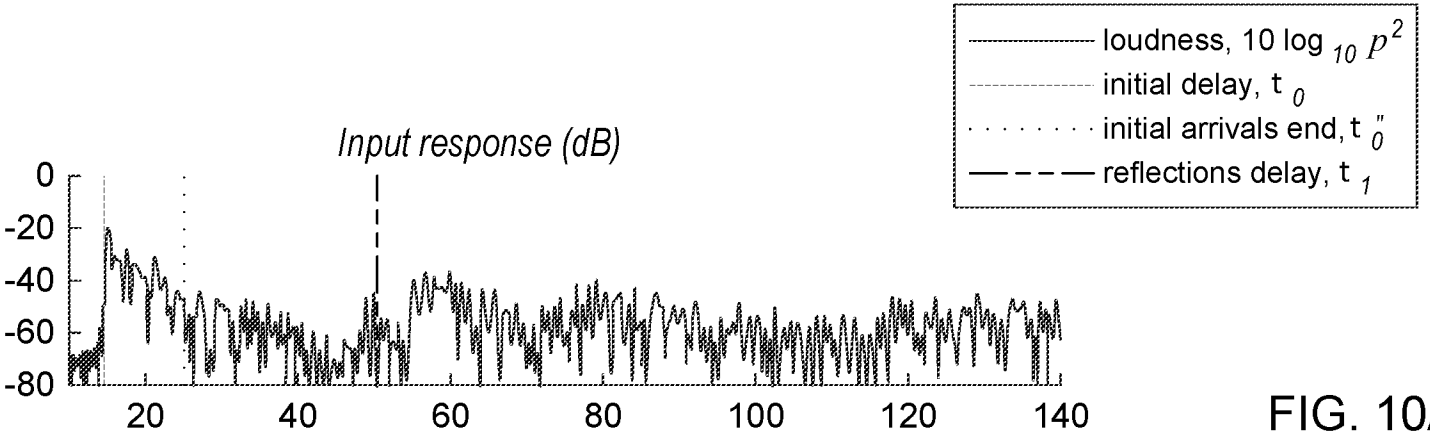
Figure 10B:
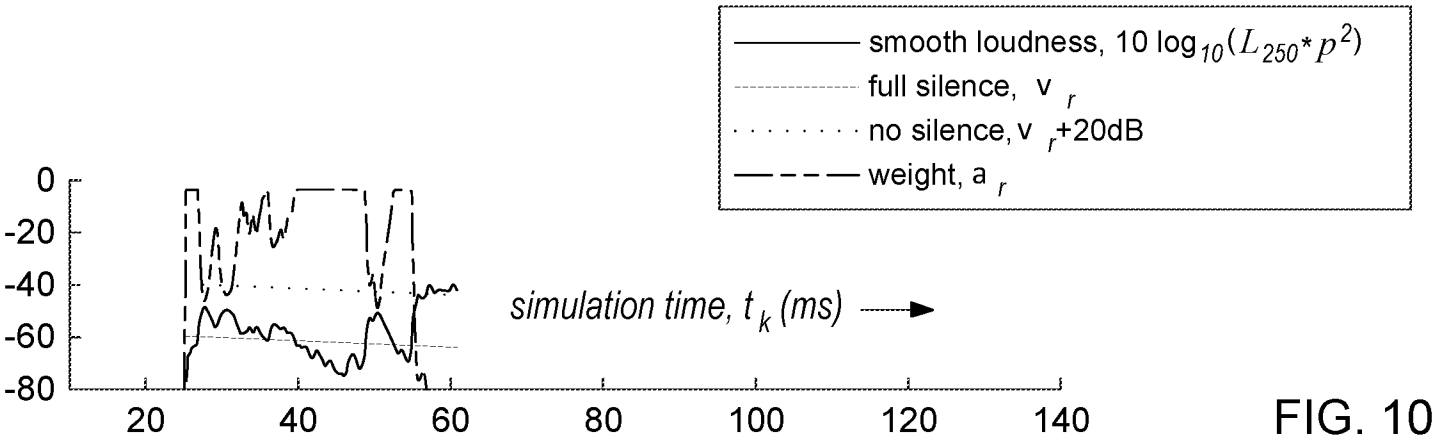

FIGS. 10A and 10B show estimation which can start after initial arrivals end at $\tau_0''$. The duration of silence can be initialized as $\Delta\tilde{\tau}_1$=10 ms, for example. The reflections delay estimate can be defined as $\tilde{\tau}_1 \equiv \tau_0+\Delta\tilde{\tau}_1$. A threshold for silence relative to the initial sound's peak energy can be defined as $\epsilon_r=-40$ dB+10 $\log_{10}(\max\{P^2(t)\}, t\in[0, \tau_0''])$. The incoming energy can be smoothed and loudness can be computed as 10 $\log_{10}(\mathcal{L}_{250} * P^2)$ then passed through the linear mapping $[\epsilon_r, \epsilon_r+20 \text{ dB}] \rightarrow [1,0]$. This can produce a weight, $a_r$ that is clamped to [0, 1], with $a_r$=1 indicating complete silence. The silence duration estimate can then be updated as $\Delta\tilde{\tau}_1 \leftarrow \Delta\tilde{\tau}_1 + a_r\Delta t$. The estimate can be considered converged when the latency $t-\tilde{\tau}_1$ increases above 10 ms (for example) for the first time, at which point $t_1 \leftarrow \tilde{\tau}_1$ can be set.

Directional Reflection Loudnesses, $R_J$

In some cases, loudness and directionality of reflections can be aggregated for 80 ms (for example) after the reflections delay ($\tau_1$). In some cases, waiting for energy to start arriving after reflecting from proximate geometry can give a relatively consistent energy estimate. In other cases, energy can be collected for a fixed interval after direct sound arrival ($\tau_0$). Directional energy can be collected using coarse cosine-squared basis functions which can be fixed in world space and can be centered around the coordinate axes $S_J$, yielding six directional loudnesses indexed by J $$R_J \equiv 10 \log_{10} \int_{\tau_0+10\,ms}^{\tau_1+80\,ms} p^2(t) \max^2((\hat{f}(t) \cdot S_J, 0)dt \quad (17)$$

Since $|\hat{f}(t)|=1$, this directional basis can form a partition of unity which preserves overall energy, and in some cases does not ring to the opposite hemisphere like low-order spherical harmonics. This approach can allow flexible control of RAM and CPU rendering cost which may not be afforded by spherical harmonics. For example, elevation information could be omitted by summing energy in ±z equally in the four horizontal directions. Alternatively, azimuthal resolution could be preferentially increased with suitable weights.

Decay Time, T

In some cases, impulse response decay time can be computed as a backward time integral of $p^2$ but a streaming encoder can lack access to future values. With appropriate causal smoothing, robust decay estimation can be performed via online linear regression on the smoothed loudness $10 \log_{10}(\mathcal{L}_{20} * p^2)$. In this case, estimation of separate early and late decays can be avoided, instead computing an overall 60 dB (for example) decay slope starting at the reflection delay, $\tau_1$.

Spatial Compression

The preceding processing can result in a set of 3D parameter fields which can vary over x for a fixed runtime listener location x'. In this case, each field can be spatially smoothed and subsampled on a uniform grid with 1.5 m resolution, for example. Fields can then be quantized and each z-slice can be sent through running differences followed by a standard byte-stream compressor (Zlib). The novel aspect can be treating the vector field of primary arrival directions, $s_0(x; x')$.

Singularity. $s_0(x; x')$ can be singular at $|x-x'|=0$. In some cases, small numerical errors in computing the spatial derivative for flux can yield large angular error when $|x-x'|$ is small. Denoting the line of sight direction as $s_0' \equiv (x'-x)/|x'-x|$, the encoded direction can be replaced with $s_0(x; x') \leftarrow s_0'$ when the distance is small and propagation is safely unoccluded; i.e., if $|x-x'|<2$ m and $L(x; x')>-1$ dB, for example. When interpolating, the singularity-free field $s_0-s_0'$ can be used, the $s_0'$ can be added back to the interpolated result, and a renormalization to a unit vector can be performed.

Compressing directions. Since $s_0$ is a unit vector, in some cases encoding its 3D Cartesian components can waste memory and/or yield anisotropic angular resolution. This problem can also arise when compressing normal maps for visual rendering. A simple solution can be tailored which first transforms to an elevation/azimuth angular representation: $s_0 \rightarrow (\theta, \phi)$ Simply quantizing azimuth, $\phi$, can result in artificial incoherence when $\phi$ jumps between 0 and $2\pi$. In some cases, only running differences may be needed for compression and can use the update rule $\Delta\phi \leftarrow \arg\min_{x \in \{\Delta\phi, \Delta\phi+2\pi, \Delta\phi-2\pi\}} |x|$. This can encode the signed shortest arc connecting the two input angles, avoiding artificial jumps.

Quantization. Discretization quanta for $\{\tau_0, L, s_0, \tau_1, R_*, T\}$ can be given by {2 ms, 2 dB, (6.0°),2.8°, 2 ms, 3 dB, 3}, for example. The primary arrival direction, $s_0$, can list quanta for $(\theta, \phi)$ respectively. Decay time T can be encoded as $\log_{1.05}(T)$.

Stage Three—Rendering

The additional example implementations described in this section can be similar to the Stage Three parametric directional propagation concepts shown in FIG. 6.

Figure 11:
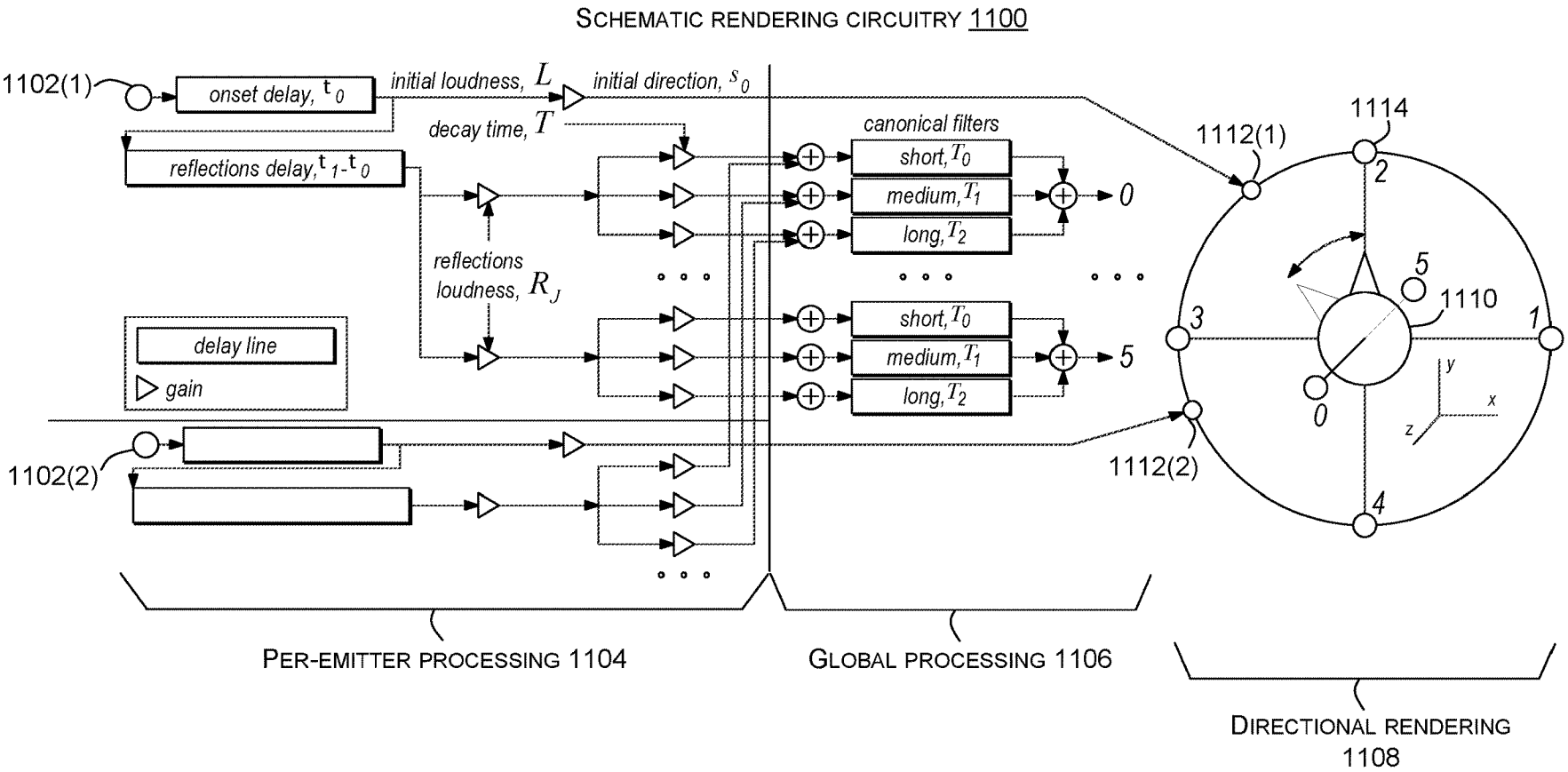

FIG. 11 shows example schematic rendering circuitry 1100. FIG. can include sound event inputs 1102. For purposes of explanation, in FIG. 11 schematic rendering circuitry 1100 can be organized generally as performing per-emitter processing 1104 and global processing 1106, to produce directional rendering 1108 for a listener 1110. Here, 'per-emitter processing' can refer to processing sound event input(s) from individual sound events (e.g., 1102(1) and 1102(2)), which may also originate from separate sound sources. In some implementations, rendering of sound by schematic rendering circuitry 1100 can be similar to rendering 612 in FIG. 6. For example, with reference to FIG. 6, schematic rendering circuitry 1100 can perform runtime rendering 612 of sound event inputs 620 utilizing the perceptual parameter fields 618 produced by Stage Two perceptual encoding 610.

The right portion of FIG. 11 (designated generally as directional rendering 1108) depicts listener 1110 and directionality of incoming rendered sounds. For example, FIG. 11 includes incoming initial sound directions 1112(1) of a rendered initial sound (such as rendered initial sound 626, FIG. 6), corresponding to sound event input 1102(1). FIG. 11 also depicts world directions 0, 1, 2, 3, 4, and 5 arranged around the listener 1110. In some cases, the world directions can be considered incoming sound reflection directions 1114 of rendered sound reflections (such as rendered sound reflections 628, FIG. 6) (only one is designated to avoid clutter on the drawing page).

In some implementations, initial sounds associated with sound event inputs 1102 can be rendered with per-emitter processing 1104, using the perceptual parameter fields (e.g., 618 described above relative to FIG. 6). Stated another way, the initial sounds can be rendered individually per sound event. Also, some aspects of sound reflections of the sound event inputs 1102 can be processed on a per-emitter (e.g., per sound event) basis, also using the perceptual parameter fields 618.

In some cases, the perceptual parameter fields 618 can be stored in a data file (introduced above relative to FIG. 6), which can be accessed and/or used by the schematic rendering circuitry 1100 to render realistic sound. In FIG. 11, the use of perceptual parameter fields is apparent through various elements shown in the per-emitter processing 1104 portion of schematic rendering circuitry 1100. In some cases, the perceptual parameter fields can contain and/or be used to compute any of: onset delay, initial loudness, initial direction, decay time, reflections delay, reflections loudness, and/or other variables, as described above relative to the description of Stage Two, for example.

In some implementations, at least some data related to sound reflections from multiple sound event inputs 1102 can be aggregated (e.g., summed) in the global processing 1106 portion of FIG. 11. In some cases, per-emitter processing 1104 can be designed to have relatively lower processing cost as compared to the global processing 1106. Alternatively or additionally, where global processing includes aggregation of at least some aspects of the sound reflections from multiple sound event inputs, an overall cost of global processing for multiple sound event inputs can be reduced. As such, global processing can be used to lower sensitivity of processing expenses in Stage Three to a number of sound event inputs and/or sound sources (e.g., increasing number of sound sources only slightly increases global processing resources).

Note that FIG. 11 presents an abbreviated view of this example of global processing 1106, in that only 6 of 18 canonical filters (e.g., directional canonical filters) of global processing 1106 are shown to avoid clutter on the drawing page. As noted, in this example, there can be three canonical filters for each world direction 0, 1, 2, 3, 4, and 5 (e.g., sound reflection direction 1114) for a total of 18 canonical filters. However, a potentially important aspect of the global processing 1106 is that increasing the number of sound sources has relatively minimal impact on the computing resources utilized to achieve global processing. For instance, a single sound source can generate a sound event that approaches the listener from direction 2, for instance. The processing of this signal can be accomplished with the three timeframe canonical filters (short, medium, and long) for direction 2. Adding additional sound events (which may also be from additional sound sources) from this same direction utilizes few additional resources. For instance, adding a hundred more sound events might double the processing resources rather than causing an exponential increase as would be experienced with previous techniques.

An example implementation of sound rendering utilizing parametric directional propagation concepts is provided below, with reference to FIG. 11.

Runtime signal processing. In some cases, per-emitter (e.g., source) processing can be determined by dynamically decoded values for the parameters (e.g., perceptual parameter fields described above relative to Stage Two) based on runtime source and listener location(s). Although the parameters can be computed on bandlimited simulations, rendering can apply them for the full audible range in some cases, thus implicitly performing frequency extrapolation.

Initial sound. Starting at the top left of FIG. 11, the mono source signal can be sent to a variable delay line to apply the initial arrival delay, $\tau_0$. This can also naturally capture environmental Doppler shift effects based on the (potentially) shortest path through the environment. Next, a gain can be applied driven by the initial loudness, L (as $10^{L/20}$) and the resulting signal can be sent for rendering at the primary arrival direction, $s_0$, shown on the right side of FIG. 11 (see initial sound directions 1112).

Directional canonical filters. As discussed above, to avoid the cost of per-source convolution, canonical filters can be used to incorporate directionality for sound reflections. In some cases, for (potentially) all combinations of the world axial directions $S_J$ and possible RT60 decay times $\{T_I\}=\{0.5\text{ s}, 1.5\text{ s}, 3\text{ s}\}$, a mono canonical filter can be built as a collection of delta peaks whose amplitude can decay exponentially, mixed with Gaussian white noise that can increase quadratically with time. The peak delays can be matched across all $\{S_J\}$ to allow coloration-free interpolation and, as discussed shortly, ensure summing localization, for example. The same pseudo-random signal can be used across $\{T_I\}$ with $S_J$ held fixed. However, independent noise signals can be used across directions $\{S_J\}$ to achieve interaural decorrelation, which can aid in natural, enveloping reverberation.

For each direction $S_J$, the output across filters for various decay times $\{T_I\}$ can be summed and then rendered as arriving from world direction $S_J$. This can be different from multi-channel surround encodings where the canonical directions can be fixed in the listener's frame of reference rather than in the world. Because canonical filters can share time delays for peaks, interpolating between them across $\{S_J\}$ can result in summing localization, which can create the perception of reverberation arriving from an intermediate direction. This can exploit summing localization in the same way as speaker panning, discussed above.

Reflections and reverberation. The output of the onset delay line can be fed into a reflection delay line that can render the variable delay $\tau_1-\tau_0$, thus realizing the net reflection delay of $\tau_1$ on the input signal. The output can then be scaled by the gains $\{10^{R_J/20}\}$ to render the directional amplitude distribution. To incorporate the decay time T, three weights can be computed corresponding to canonical decay times $\{T_I\}$ which can further multiply the directional gains. The results can be summed into the inputs of the 18 canonical filters (6 directions×3 decay times). To reduce the cost of scaling and summing into 18 filter inputs, in some cases only 12 of these may be nonzero, which can correspond to the two decay times in $\{T_I\}$ that bracket the actual decay time T decoded. (Note that implementations employing different numbers of directions and/or decay times are contemplated).

Spatialization. Directional rendering 1108 (depicted in the right portion of FIG. 11) can be device dependent and the present concepts can be agnostic to its details. The impression can be formed that an input mono signal arrives from its associated input world direction, producing multiple signals for playback on output hardware of a user. Recall that directions can arise from the per-emitter primary arrival direction, $s_0$, and/or from the fixed canonical directions, $S_J$. These incoming world directions, denoted $s_w$, can be first transformed into the listener's reference frame, $s_l=R^{-1}(s_w)$.

In some cases, the results binaurally render using generic HRTFs for headphones. Nearest-neighbor look up can be performed in the HRTF dataset to the direction $s_l$, and can then convolve (using partitioned, frequency-domain convolution) the input signal with the per-ear HRTFs to produce a binaural output buffer at each audio tick. To avoid popping artifacts, the audio buffer of the input signal can be cross-faded with complementary sigmoid windows and fed to HRTFs corresponding to $s_l$ at the previous and current audio tick, for example. Other spatialization approaches can easily be substituted. For example, instead of HRTFs, panning weights can be computed given $s_l$ to produce multi-channel signals for speaker playback in a stereo, 5.1 or 7.1 surround, and/or with-elevation setups.

Example System

Figure 12:
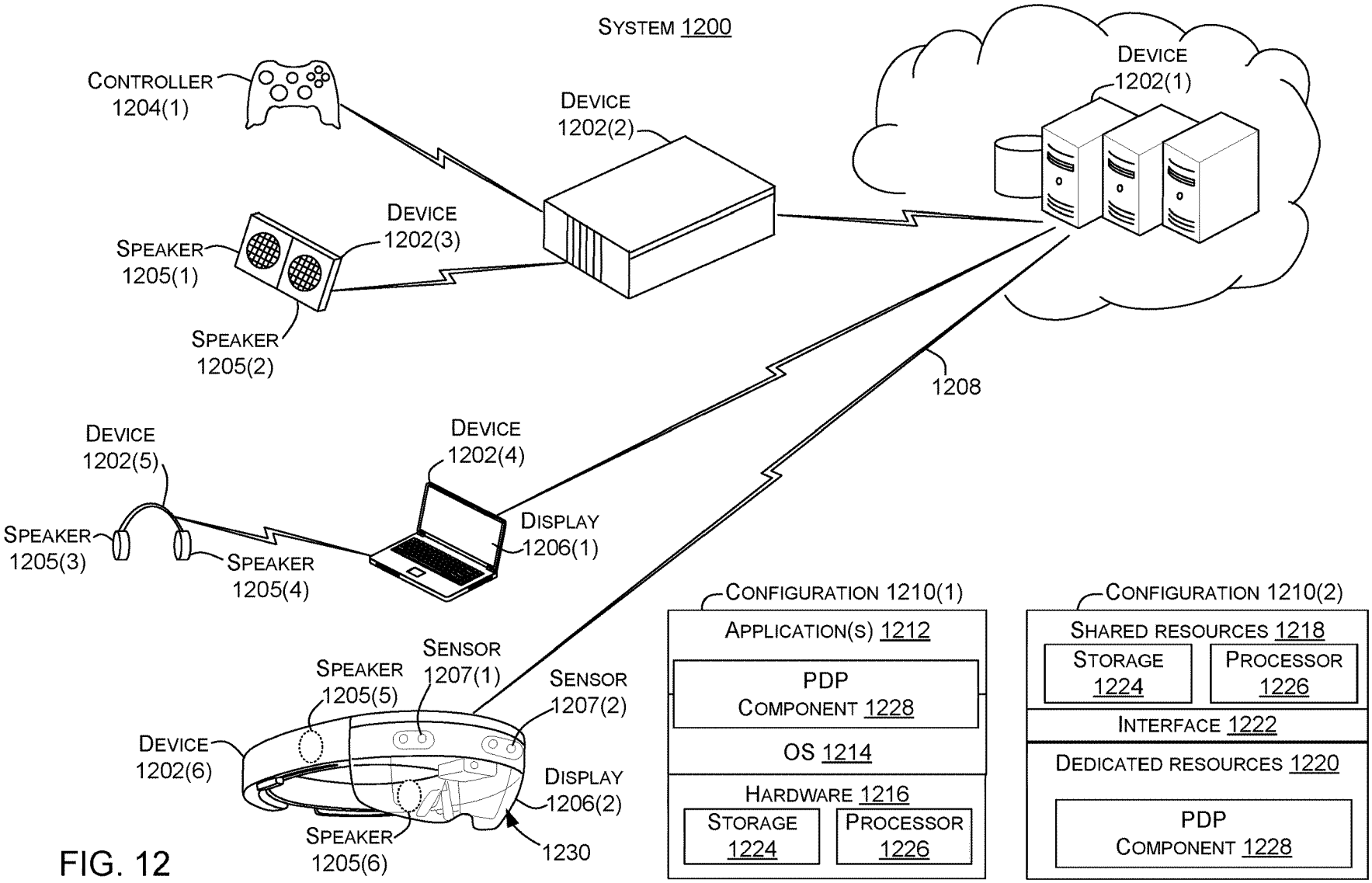

FIG. 12 shows a system 1200 that can accomplish parametric directional propagation concepts. For purposes of explanation, system 1200 can include one or more devices 1202. The device may interact with and/or include controllers 1204 (e.g., input devices), speakers 1205, displays 1206, and/or sensors 1207. The sensors can be manifest as various 2D, 3D, and/or microelectromechanical systems (MEMS) devices. The devices 1202, controllers 1204, speakers 1205, displays 1206, and/or sensors 1207 can communicate via one or more networks (represented by lightning bolts 1208).

In the illustrated example, example device 1202(1) is manifest as a server device, example device 1202(2) is manifest as a gaming console device, example device 1202(3) is manifest as a speaker set, example device 1202(4) is manifest as a notebook computer, example device 1202(5) is manifest as headphones, and example device 1202(6) is manifest as a virtual reality head-mounted display (HMD) device. While specific device examples are illustrated for purposes of explanation, devices can be manifest in any of a myriad of ever-evolving or yet to be developed types of devices.

In one configuration, device 1202(2) and device 1202(3) can be proximate to one another, such as in a home video game type scenario. In other configurations, devices 1202 can be remote. For example, device 1202(1) can be in a server farm and can receive and/or transmit data related to parametric directional propagation concepts.

FIG. 12 shows two device configurations 1210 that can be employed by devices 1202. Individual devices 1202 can employ either of configurations 1210(1) or 1210(2), or an alternate configuration. (Due to space constraints on the drawing page, one instance of each device configuration is illustrated rather than illustrating the device configurations relative to each device 1202.) Briefly, device configuration 1210(1) represents an operating system (OS) centric configuration. Device configuration 1210(2) represents a system on a chip (SOC) configuration. Device configuration 1210 (1) is organized into one or more application(s) 1212, operating system 1214, and hardware 1216. Device configuration 1210(2) is organized into shared resources 1218, dedicated resources 1220, and an interface 1222 there between.

In either configuration 1210, the device can include storage/memory 1224, a processor 1226, and/or a parametric directional propagation (PDP) component 1228. In some cases, the PDP component 1228 can be similar to the parametric directional propagation component 602 introduced above relative to FIG. 6. The PDP component 1228 can be configured to perform the implementations described above and below.

In some configurations, each of devices 1202 can have an instance of the PDP component 1228. However, the functionalities that can be performed by PDP component 1228 may be the same or they may be different from one another. In some cases, each device's PDP component 1228 can be robust and provide all of the functionality described above and below (e.g., a device-centric implementation). In other cases, some devices can employ a less robust instance of the PDP component 1228 that relies on some functionality to be performed remotely. For instance, the PDP component 1228 on device 1202(1) can perform parametric directional propagation concepts related to Stages One and Two, described above (FIG. 6) for a given environment, such as a video game. In this instance, the PDP component 1228 on device 1202(2) can communicate with device 1202(1) to receive perceptual parameter fields 618 (FIG. 6). The PDP component 1228 on device 1202(2) can utilize the perceptual parameter fields with sound event inputs to produce rendered sound 606 (FIG. 6), which can be played by speakers 1205(1) and 1205(2) for the user.

In the example of device 1202(6), the sensors 1207 can provide information about the orientation of a user of the device (e.g., the user's head and/or eyes relative to visual content presented on the display 1206(2)). In device 1202 (6), a visual representation 1230 (e.g., visual content, graphical use interface) can be presented on display 1206(2). In some cases, the visual representation can be based at least in part on the information about the orientation of the user provided by the sensors. Also, the PDP component 1228 on device 1202(6) can receive perceptual parameter fields from device 1202(1). In this case, the PDP component 1228(6) can produce rendered sound that has accurate directionality in accordance with the representation. Stated another way, stereoscopic sound can be rendered through the speakers 1205(5) and 1205(6) in proper orientation to a visual scene or environment, to provide convincing sound to enhance the user experience.

In still another case, Stage One and Two described above can be performed relative to a virtual/augmented reality space (e.g., virtual environment), such as a video game. The output of these stages (e.g., perceptual parameter fields (618 of FIG. 6)) can be added to the video game as a plugin that also contains code for Stage Three (FIG. 11). At run time, when a sound event occurs, the plugin can apply the perceptual parameter fields to the sound event to compute the corresponding rendered sound for the sound event.

The term "device," "computer," or "computing device" as used herein can mean any type of device that has some amount of processing capability and/or storage capability. Processing capability can be provided by one or more processors that can execute data in the form of computer-readable instructions to provide a functionality. Data, such as computer-readable instructions and/or user-related data, can be stored on storage, such as storage that can be internal or external to the device. The storage can include any one or more of volatile or non-volatile memory, hard drives, flash storage devices, and/or optical storage devices (e.g., CDs, DVDs etc.), remote storage (e.g., cloud-based storage), among others. As used herein, the term "computer-readable media" can include signals. In contrast, the term "computer-readable storage media" excludes signals. Computer-readable storage media includes "computer-readable storage devices." Examples of computer-readable storage devices include volatile storage media, such as RAM, and non-volatile storage media, such as hard drives, optical discs, and flash memory, among others.

As mentioned above, device configuration 1210(2) can be thought of as a system on a chip (SOC) type design. In such a case, functionality provided by the device can be integrated on a single SOC or multiple coupled SOCs. One or more processors 1226 can be configured to coordinate with shared resources 1218, such as storage/memory 1224, etc., and/or one or more dedicated resources 1220, such as hardware blocks configured to perform certain specific functionality. Thus, the term "processor" as used herein can also refer to central processing units (CPUs), graphical processing units (GPUs), field programmable gate arrays (FPGAs), controllers, microcontrollers, processor cores, or other types of processing devices.

Generally, any of the functions described herein can be implemented using software, firmware, hardware (e.g., fixed-logic circuitry), or a combination of these implementations. The term "component" as used herein generally represents software, firmware, hardware, whole devices or networks, or a combination thereof. In the case of a software implementation, for instance, these may represent program code that performs specified tasks when executed on a processor (e.g., CPU or CPUs). The program code can be stored in one or more computer-readable memory devices, such as computer-readable storage media. The features and techniques of the component are platform-independent, meaning that they may be implemented on a variety of commercial computing platforms having a variety of processing configurations.

Example Methods

Detailed example implementations of parametric directional propagation concepts have been provided above. The example methods provided in this section are merely intended to summarize the present parametric directional propagation concepts.

FIGS. 13-16 show example parametric directional propagation methods 1300-1600.

Figure 13:
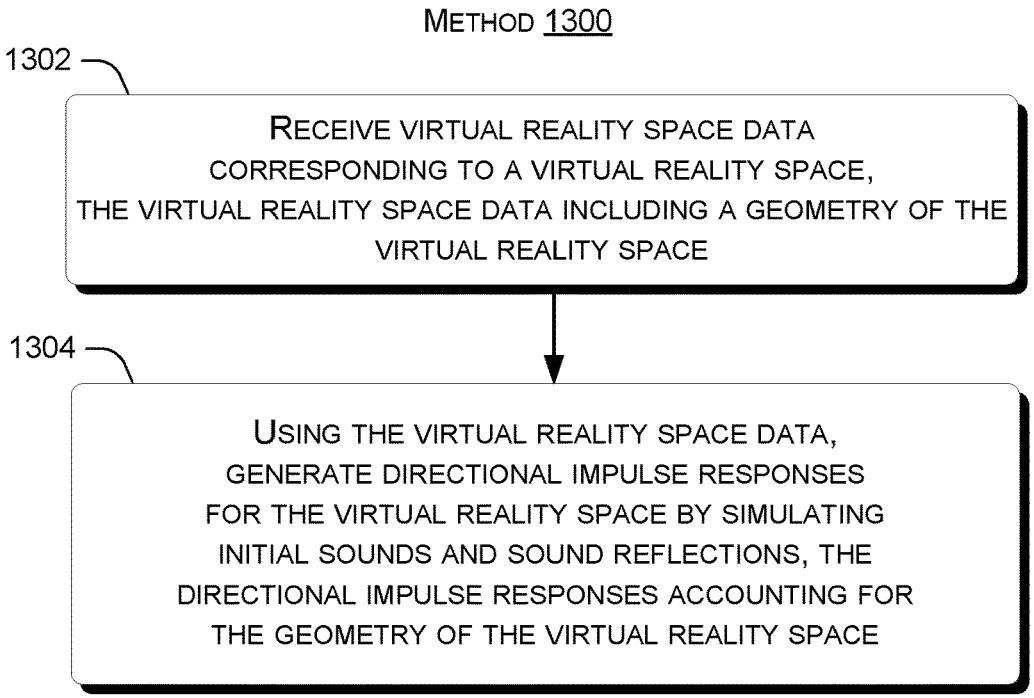
FIGS. 13-16 are flowcharts of example parametric directional propagation methods in accordance with some implementations of the present concepts.

As shown in FIG. 13, at block 1302, method 1300 can receive virtual reality space data corresponding to a virtual reality space. In some cases, the virtual reality space data can include a geometry of the virtual reality space. For instance, the virtual reality space data can describe structures, such as surface(s) and/or portal(s). The virtual reality space data can also include additional information related to the geometry, such as surface texture, material, thickness, etc.

At block 1304, method 1300 can use the virtual reality space data to generate directional impulse responses for the virtual reality space. In some cases, method 1300 can generate the directional impulse responses by simulating initial sounds emanating from multiple moving sound sources and/or arriving at multiple moving listeners. Method 1300 can also generate the directional impulse responses by simulating sound reflections in the virtual reality space. In some cases, the directional impulse responses can account for the geometry of the virtual reality space.

Figure 14:
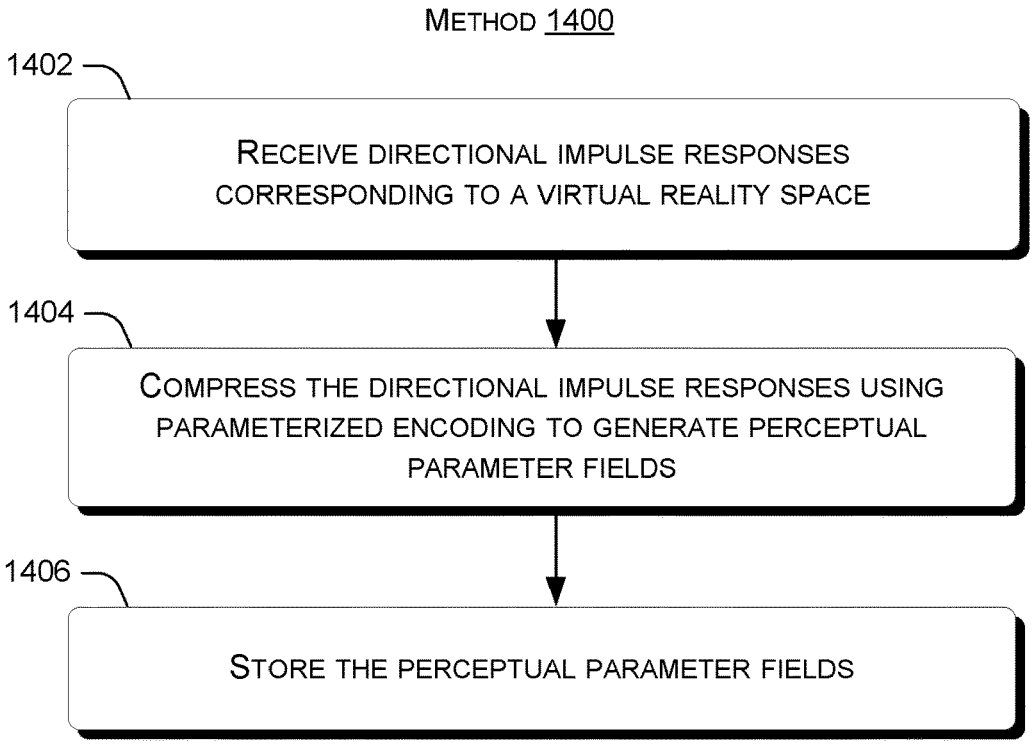

As shown in FIG. 14, at block 1402, method 1400 can receive directional impulse responses corresponding to a virtual reality space. The directional impulse responses can correspond to multiple sound source locations and/or multiple listener locations in the virtual reality space.

At block 1404, method 1400 can compress the directional impulse responses using parameterized encoding. In some case, the compression can generate perceptual parameter fields.

At block 1406, method 1400 can store the perceptual parameter fields. For instance, method 1400 can store the perceptual parameter fields on storage of a parametric directional propagation system.

Figure 15:
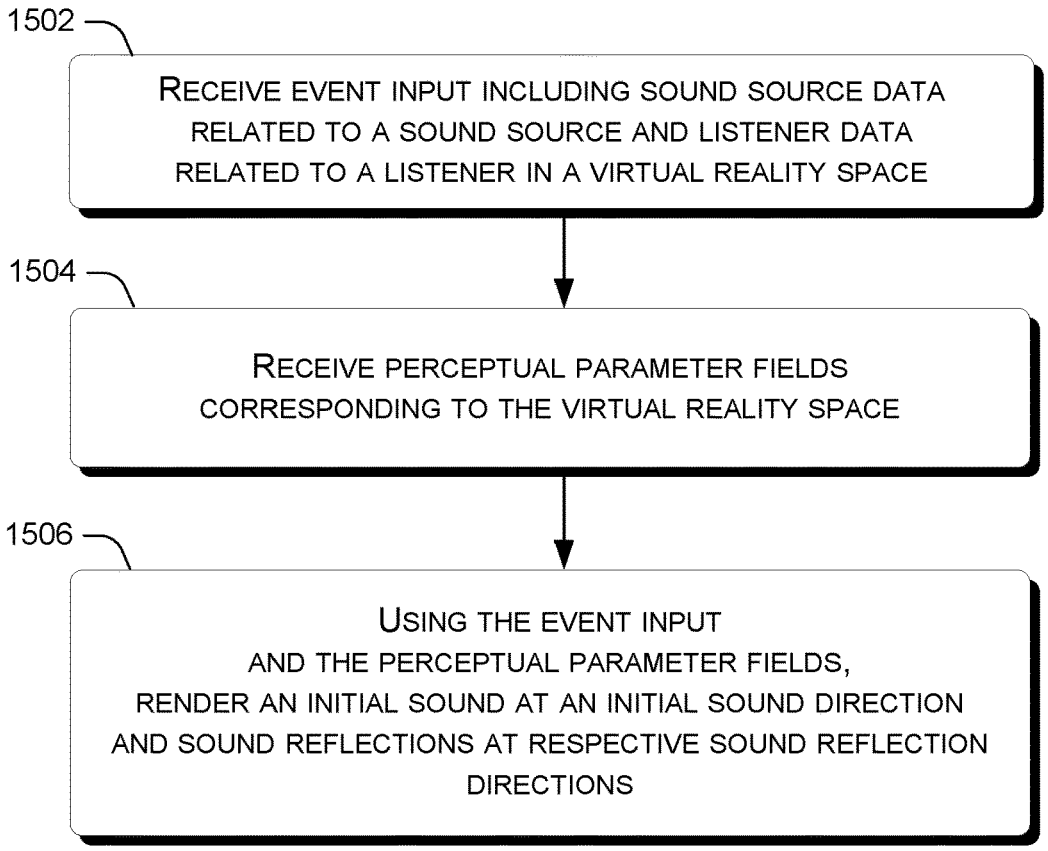

As shown in FIG. 15, at block 1502, method 1500 can receive sound event input. The sound event input can include sound source data related to a sound source and listener data related to a listener in a virtual reality space.

At block 1504, method 1500 can receive perceptual parameter fields corresponding to the virtual reality space.

At block 1506, method 1500 can use the sound event input and the perceptual parameter fields to render an initial sound at an initial sound direction. Method 1500 can also use the sound event input and the perceptual parameter fields to render sound reflections at respective sound reflection directions.

Figure 16:
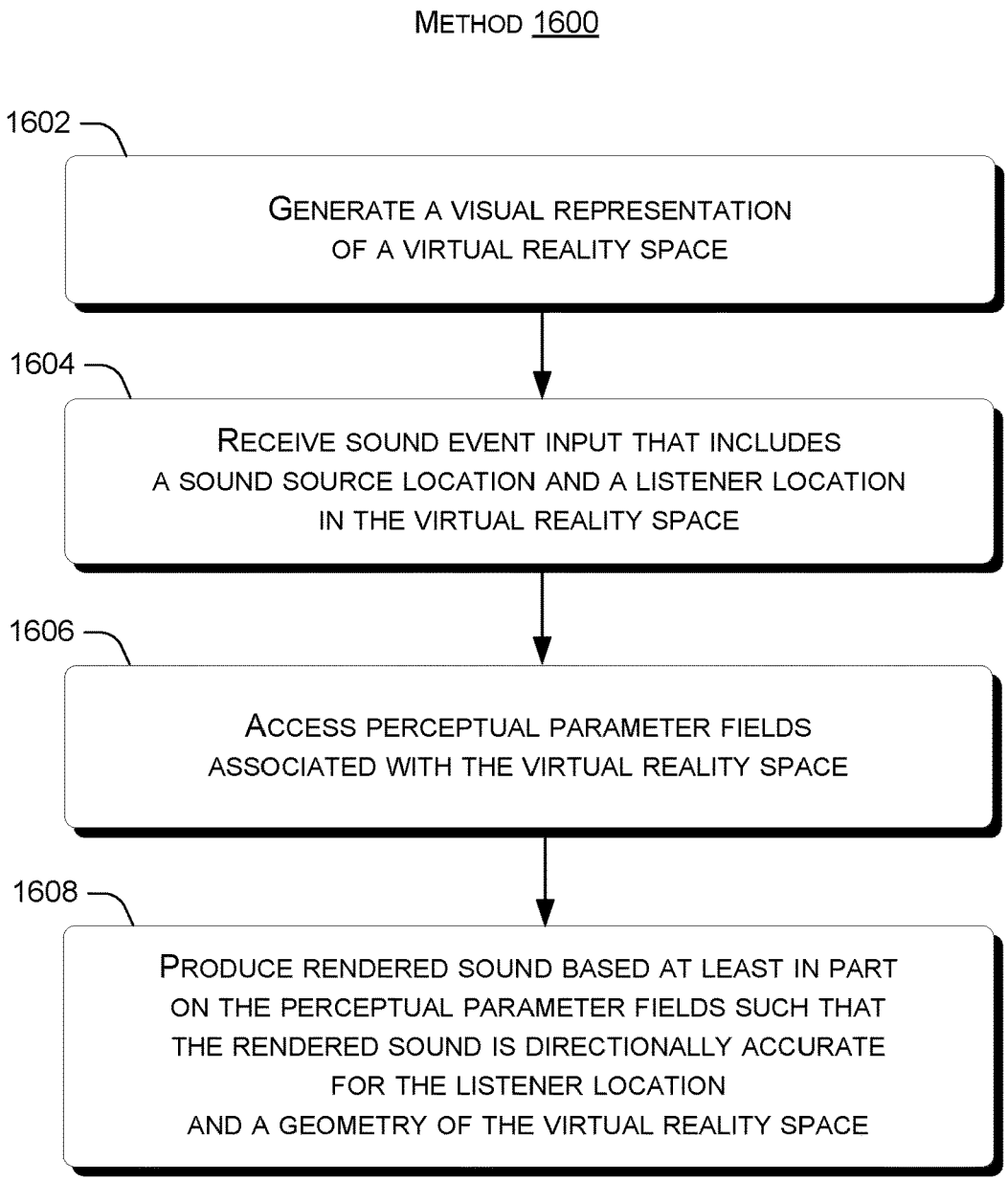

As shown in FIG. 16, at block 1602, method 1600 can generate a visual representation of a virtual reality space.

At block 1604, method 1600 can receive sound event input. In some cases, the sound event input can include a sound source location and/or a listener location in the virtual reality space.

At block 1606, method 1600 can access perceptual parameter fields associated with the virtual reality space.

At block 1608, method 1600 can produce rendered sound based at least in part on the perceptual parameter fields. In some cases, the rendered sound can be directionally accurate for the listener location and/or a geometry of the virtual reality space.

The described methods can be performed by the systems and/or devices described above relative to FIGS. 6 and/or 12, and/or by other devices and/or systems. The order in which the methods are described is not intended to be construed as a limitation, and any number of the described acts can be combined in any order to implement the methods, or an alternate method(s). Furthermore, the methods can be implemented in any suitable hardware, software, firmware, or combination thereof, such that a device can implement the methods. In one case, the method or methods are stored on computer-readable storage media as a set of instructions such that execution by a computing device causes the computing device to perform the method(s).

Additional Examples

Various examples are described above. Additional examples are described below. One example includes a system comprising a processor and storage, storing computer-readable instructions. When executed by the processor, the computer-readable instructions cause the processor to receive virtual reality space data corresponding to a virtual reality space, the virtual reality space data including a geometry of the virtual reality space. Using the virtual reality space data, the processor generates directional impulse responses for the virtual reality space by simulating initial sound wavefronts and sound reflection wavefronts emanating from multiple moving sound sources and arriving at multiple moving listeners, the directional impulse responses accounting for the geometry of the virtual reality space.

Another example can include any of the above and/or below examples where the simulating comprises a precomputed wave technique.

Another example can include any of the above and/or below examples where the simulating comprises using acoustic flux density to construct the directional impulse responses.

Another example can include any of the above and/or below examples where the directional impulse responses are nine-dimensional (9D) directional impulse responses.

Another example can include any of the above and/or below examples where the geometry includes an occluder between at least one sound source location and at least one listener location, and the directional impulse responses account for the occluder.

Another example includes a system comprising a processor and storage, storing computer-readable instructions. When executed by the processor, the computer-readable instructions cause the processor to receive directional impulse responses corresponding to a virtual reality space, the directional impulse responses corresponding to multiple sound source locations and multiple listener locations in the virtual reality space. The computer-readable instructions further cause the processor to compress the directional impulse responses using parameterized encoding to generate perceptual parameter fields, and store the perceptual parameter fields on the storage.

Another example can include any of the above and/or below examples where the parameterized encoding uses 9D parameterization that accounts for incoming directionality of the initial sounds at a listener location.

Another example can include any of the above and/or below examples where the perceptual parameter fields relate to both initial sounds and sound reflections.

Another example can include any of the above and/or below examples where the perceptual parameter fields account for a reflection delay between the initial sounds and the sound reflections.

Another example can include any of the above and/or below examples where the perceptual parameter fields account for a decay of the sound reflections over time.

Another example can include any of the above and/or below examples where an individual directional impulse response corresponds to an individual sound source location and listener location pair in the virtual reality space.

Another example includes a system comprising a processor and storage, storing computer-readable instructions. When executed by the processor, the computer-readable instructions cause the processor to receive sound event input including sound source data related to a sound source and listener data related to a listener in a virtual reality space. The computer-readable instructions further cause the processor to receive perceptual parameter fields corresponding to the virtual reality space, and using the sound event input and the perceptual parameter fields, render an initial sound at an initial sound direction and sound reflections at respective sound reflection directions.

Another example can include any of the above and/or below examples where the initial sound direction is an incoming direction of the initial sound at a location of the listener in the virtual reality space.

Another example can include any of the above and/or below examples where the perceptual parameter fields include the initial sound direction at a location of the listener and the respective sound reflection directions at the location of the listener.

Another example can include any of the above and/or below examples where the perceptual parameter fields account for an occluder in the virtual reality space between a location of the sound source and the location of the listener.

Another example can include any of the above and/or below examples where the initial sound is a first initial sound and the computer-readable instructions further cause the processor to render a second initial sound at a different initial sound direction than the first initial sound based at least in part on an occluder between the sound source and the listener in the virtual reality space.

Another example can include any of the above and/or below examples where the computer-readable instructions further cause the processor to render the initial sound on a per sound event basis.

Another example can include any of the above and/or below examples where the sound event input corresponds to multiple sound events and wherein the computer-readable instructions further cause the processor to render the sound reflections by aggregating the sound source data from the multiple sound events.

Another example can include any of the above and/or below examples where the computer-readable instructions further cause the processor to aggregate the sound source data from the multiple sound events using directional canonical filters.

Another example can include any of the above and/or below examples where the directional canonical filters group the sound source data from the multiple sound events into the respective sound reflection directions.

Another example can include any of the above and/or below examples where the sound event input corresponds to multiple sound sources and wherein the computer-readable instructions further cause the processor to aggregate the sound source data with additional sound source data related to at least one additional sound source in the virtual reality space using the directional canonical filters to render the sound reflections.

Another example can include any of the above and/or below examples where the directional canonical filters sum a portion of the sound source data corresponding to a decay time.

Another example includes a system comprising a processor and storage, storing computer-readable instructions. When executed by the processor, the computer-readable instructions cause the processor to generate a visual representation of a virtual reality space, receive sound event input that includes a sound source location and a listener location in the virtual reality space, access perceptual parameter fields associated with the virtual reality space, and produce rendered sound based at least in part on the perceptual parameter fields such that the rendered sound is directionally accurate for the listener location and a geometry of the virtual reality space.

Another example can include any of the above and/or below examples where the system is embodied on a gaming console.

Another example can include any of the above and/or below examples where the rendered sound is directionally accurate for an initial sound direction and a sound reflection direction of the rendered sound.

Another example can include any of the above and/or below examples where the geometry includes an occluder located between the sound source location and the listener location in the virtual reality space and the rendered sound is directionally accurate with respect to the occluder.

Another example can include any of the above and/or below examples where the computer-readable instructions further cause the processor to generate the visual representation and produce the rendered sound based at least in part on a voxel map for the virtual reality space.

Another example can include any of the above and/or below examples where the perceptual parameter fields are generated based at least in part on the voxel map.

Another example can include any of the above and/or below examples where the voxel map includes an occluder located between the sound source location and the listener location, and the rendered sound accounts for the occluder.

CONCLUSION

The description relates to parametric directional propagation concepts. In one example, parametric directional propagation can be used to create accurate and immersive sound renderings for video game and/or virtual reality experiences. The sound renderings can include higher fidelity, more realistic sound than available through other sound modeling and/or rendering methods. Furthermore, the sound renderings can be produced within reasonable processing and/or storage budgets.

Although techniques, methods, devices, systems, etc., pertaining to providing parametric directional propagation are described in language specific to structural features and/or methodological acts, it is to be understood that the subject matter defined in the appended claims is not necessarily limited to the specific features or acts described. Rather, the specific features and acts are disclosed as exemplary forms of implementing the claimed methods, devices, systems, etc.

The invention claimed is:

1. A system, comprising:

a processor; and storage storing computer-readable instructions which, when executed by the processor, cause the processor to:

receive directional impulse responses corresponding to a virtual reality space, the directional impulse responses corresponding to multiple sound source locations and multiple listener locations in the virtual reality space, and specifying perceived arrival directions of initial sounds at individual listener locations as emitted from individual source locations based at least on geometry included in the virtual reality space;

compress the directional impulse responses using parameterized encoding to generate perceptual parameter fields; and store the perceptual parameter fields on the storage, the perceived arrival directions being encoded in the perceptual parameter fields, and the perceived arrival directions encoded in the perceptual parameter fields providing a basis for subsequent rendering of directional initial sounds emanating from specific source locations and arriving at specific listener locations as perceived by specific listeners and accounting for reference frames of the specific listeners in the virtual reality space.

2. The system of claim 1, wherein the parameterized encoding uses 9D parameterization that accounts for the perceived arrival directions.

3. The system of claim 1, wherein the perceptual parameter fields relate to both the initial sounds and sound reflections.

4. The system of claim 3, wherein the perceptual parameter fields account for an initial sound delay before the initial sounds.

5. The system of claim 3, wherein the perceptual parameter fields account for a reflection delay between the initial sounds and the sound reflections.

6. The system of claim 3, wherein the perceptual parameter fields account for a decay of the sound reflections over time.

7. A system, comprising:

a processor; and storage storing computer-readable instructions which, when executed by the processor, cause the processor to:

receive sound event input including sound source data related to a particular sound source having a particular sound source location in a virtual reality space and listener data related to a particular listener having a particular listener location in the virtual reality space;

access perceptual parameters corresponding to the virtual reality space, the perceptual parameters based at least on encoded directional impulse responses specifying arrival directionality of sounds emitted from different source locations and arriving at different listener locations in the virtual reality space;

based at least on the particular sound source location and the particular listener location, identify, in the perceptual parameters, a particular arrival directionality of sound emanating from the particular sound source location as perceived at the particular listener location; and using the sound event input and the particular arrival directionality, render a directional sound as perceived by the particular listener.

8. The system of claim 7, wherein the directional sound is an initial sound.

9. The system of claim 7, wherein the perceptual parameters include initial sound arrival directions at the different listener locations and respective sound reflection directions at the different listener locations.

10. The system of claim 9, wherein the perceptual parameters account for an occluder in the virtual reality space between the particular sound source location and the particular listener location.

11. The system of claim 7, wherein the computer-readable instructions further cause the processor to:

render the directional sound on a per sound event basis.

12. The system of claim 7, wherein the sound event input corresponds to multiple sound events and wherein the computer-readable instructions further cause the processor to:

render sound reflections by aggregating the sound source data from the multiple sound events.

13. The system of claim 12, wherein the computer-readable instructions further cause the processor to:

aggregate the sound source data from the multiple sound events using directional canonical filters.

14. The system of claim 13, wherein the directional canonical filters group the sound source data from the multiple sound events into respective sound reflection directions, and wherein the directional canonical filters are each associated with a direction.

15. The system of claim 13, wherein the sound event input corresponds to multiple sound sources and wherein the computer-readable instructions further cause the processor to:

aggregate the sound source data with additional sound source data related to at least one additional sound source in the virtual reality space using the directional canonical filters to render the sound reflections.

16. The system of claim 13, wherein the directional canonical filters sum a portion of the sound source data corresponding to a decay time.

17. A system, comprising:

a processor; and storage storing computer-readable instructions which, when executed by the processor, cause the processor to:

receive sound event input that includes a specific sound source location and a specific listener location of a specific listener in a virtual reality space;

access perceptual parameter fields associated with the virtual reality space, the perceptual parameter fields specifying arrival directions of initial sound emanating from different source locations in the virtual reality space as perceived at different listener locations in the virtual reality space;

based at least on the specific sound source location and the specific listener location included in the sound event input, identify, in the perceptual parameter fields, a specific arrival direction of initial sound emanating from the specific sound source location as perceived at the specific listener location; and based at least on the specific arrival direction of initial sound, produce rendered sound accounting for a reference frame of the specific listener in the virtual reality space.

18. The system of claim 17, wherein the computer-readable instructions further cause the processor to:

generate a visual representation of the virtual reality space and produce the rendered sound based at least in part on a voxel map for the virtual reality space.

19. The system of claim 18, wherein the perceptual parameter fields are generated based at least in part on the voxel map.

20. The system of claim 18, wherein the voxel map includes an occluder located between the specific sound source location and the specific listener location, and the rendered sound accounts for the occluder.

* * * * *